US007537331B2

(12) United States Patent
Akase et al.

(10) Patent No.: US 7,537,331 B2
(45) Date of Patent: May 26, 2009

(54) PRINTING APPARATUS, PROGRAM, AND PRINTING METHOD

(75) Inventors: Takashi Akase, Nagano-ken (JP); Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 10/525,239

(22) PCT Filed: Aug. 12, 2003

(86) PCT No.: PCT/JP03/10266

§ 371 (c)(1),
(2), (4) Date: Oct. 12, 2005

(87) PCT Pub. No.: WO2004/018218

PCT Pub. Date: Mar. 4, 2004

(65) Prior Publication Data

US 2006/0170720 A1 Aug. 3, 2006

(30) Foreign Application Priority Data

Aug. 21, 2002 (JP) ..... 2002-241022

(51) Int. Cl.
*B41J 2/01* (2006.01)

(52) U.S. Cl. ..... 347/101; 347/14; 347/19; 347/104

(58) Field of Classification Search ..... 347/101
See application file for complete search history.

(56) References Cited

U.S. PATENT DOCUMENTS

| | | | | | |
|---|---|---|---|---|---|
| 3,988,744 | A | * | 10/1976 | Noda | 346/136 |
| 4,265,556 | A | * | 5/1981 | Krieg et al. | 400/342 |
| 5,277,506 | A | * | 1/1994 | Oda | 400/279 |
| 6,109,745 | A | * | 8/2000 | Wen | 347/101 |

FOREIGN PATENT DOCUMENTS

| | | | |
|---|---|---|---|
| EP | 0 526 154 | A2 | 2/1993 |
| GB | 2 170 934 | A3 | 8/1996 |
| GB | 0 884 197 | A1 | 12/1998 |
| JP | 63 112186 | A | 5/1988 |
| JP | 6-64286 | A | 3/1993 |
| JP | 05 142916 | A | 6/1993 |
| JP | 6-8596 | A | 1/1994 |
| JP | 11 240214 | A | 9/1999 |

* cited by examiner

*Primary Examiner*—Matthew Luu
*Assistant Examiner*—Brian J Goldberg
(74) *Attorney, Agent, or Firm*—Sughrue Mion, PLLC

(57) ABSTRACT

A print start position is set to an appropriate position, and the time required for printing is shortened. A printing apparatus, which forms a row of dots from a print start position in a scanning direction to print on a medium to be printed, is provided with a sensor that is capable of detecting an edge, in the scanning direction, of the medium to be printed. The printing apparatus stores the result of detecting the edge of another medium to be printed, and, when printing on the medium to be printed, it reads out the stored detection result and determines the print start position based on that detection result.

14 Claims, 16 Drawing Sheets

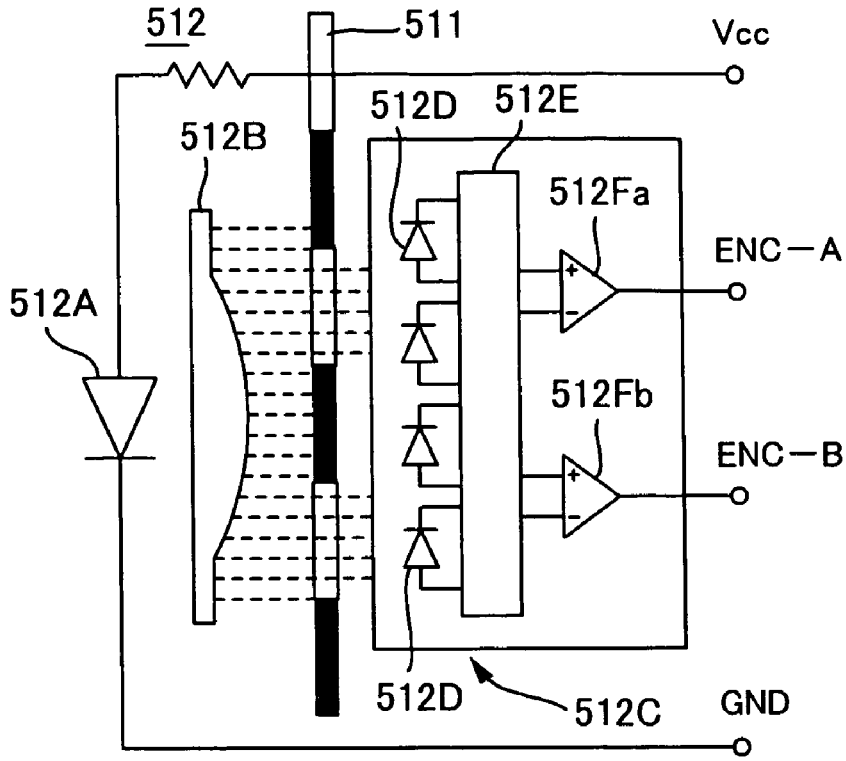
FIG. 5
FIG. 6A
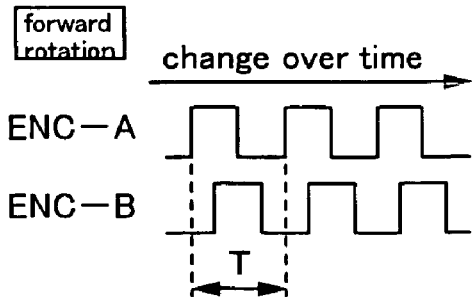
FIG. 6B
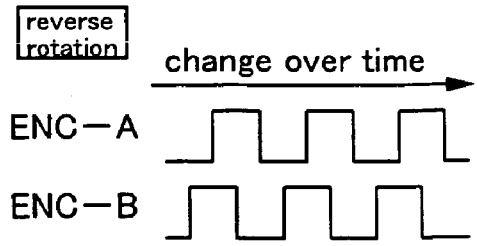

PRINTING APPARATUS, PROGRAM, AND PRINTING METHOD

TECHNICAL FIELD

The present invention relates to printing apparatuses and printing methods for printing onto a medium to be printed, such as paper. The present invention also relates to programs for controlling such printing apparatuses.

BACKGROUND ART

Inkjet printers that perform printing by intermittently ejecting ink are known as printing apparatuses for printing images onto various types of media to be printed, including paper, cloth, and film. In such inkjet printers, printing is carried out by alternately repeating a process of moving the paper in the carrying direction and positioning it, and a process of ejecting ink from nozzles while moving the nozzles in the scanning direction.

In such inkjet printers, the paper is moved in the carrying direction while the edges of the paper are guided by guides. However, since there may be manufacturing errors in the position at which the guides are provided, there are individual differences for every printer. Therefore, there has been a possibility that the print start position will differ for each printer.

Accordingly, it has been suggested to provide a paper width sensor on the printer and determine the print start position in accordance with the result that is output by this paper width sensor.

In this case, the paper width sensor may be mounted on a carriage for moving the nozzles. The printer detects both edges of the paper with the paper width sensor before printing, and determines the print start position in accordance with the results of detecting both edges.

However, in such a method, it is necessary to move the carriage in the scanning direction and detect both edges of the paper before printing. That is to say, before printing, an operation to move the carriage is necessary and thus the time required for printing becomes lengthened.

It is an object of the present invention to set the print start position to an appropriate position, as well as shorten the time required for printing.

DISCLOSURE OF INVENTION

The main aspect of the invention is a printing apparatus that forms a row of dots from a print start position in a scanning direction to print on a medium to be printed, comprising: a sensor that is capable of detecting an edge, in the scanning direction, of the medium to be printed, wherein the print start position is determined based on a result of detecting the edge of another medium to be printed.

Other features of the present invention will become clear through the present specification and the description in the accompanying drawings.

BRIEF DESCRIPTION OF DRAWINGS

FIG. 5 is an explanatory diagram showing the configuration of a linear encoder.

FIG. 6A is a timing chart of waveforms of output signals when the CR motor 42 is rotating forward.

FIG. 6B is a timing chart of waveforms of output signals when the CR motor 42 is rotating in reverse.

Figure 1:
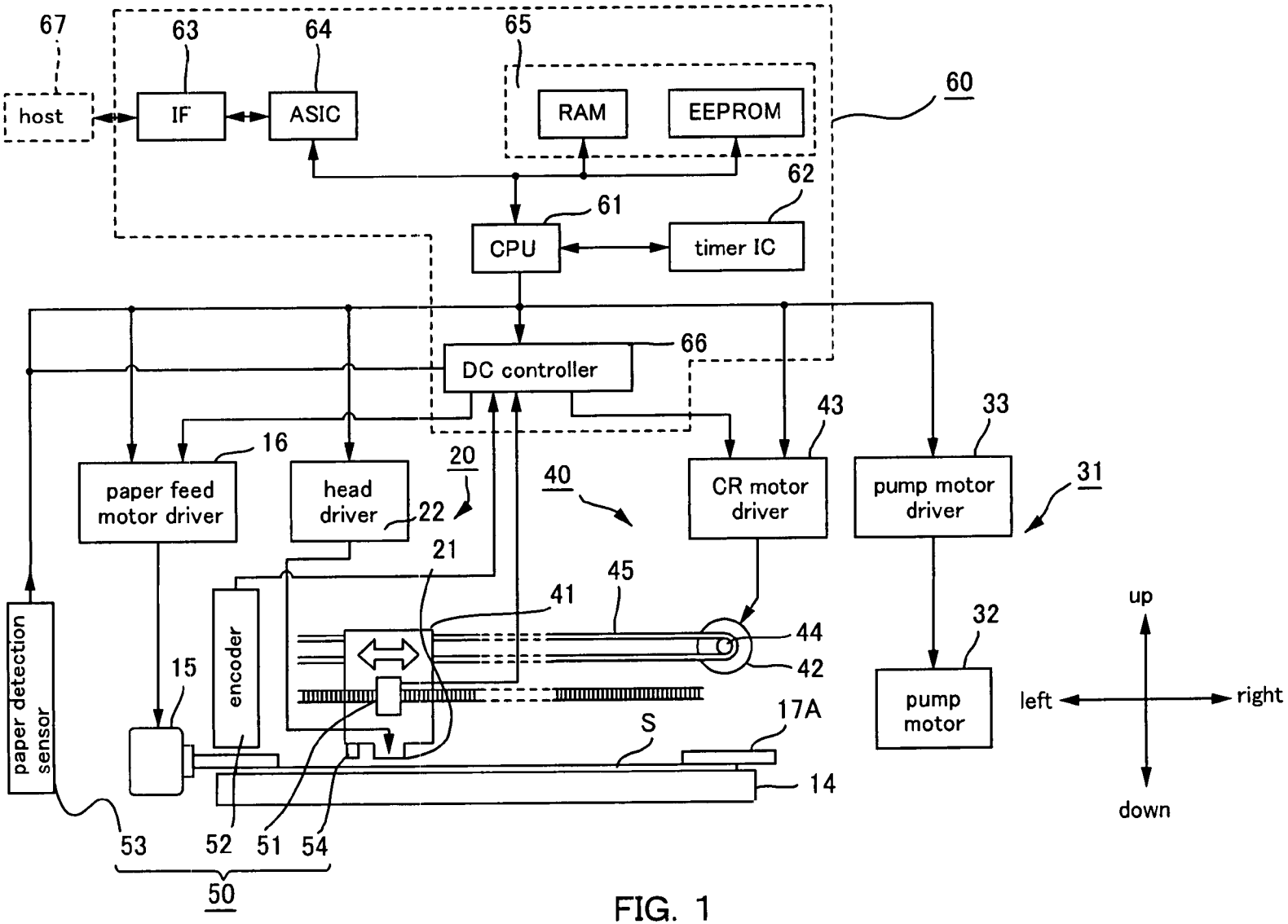
FIG. 1 is an explanatory diagram of an overall configuration of an inkjet printer of the present embodiment.

A legend of the main reference numerals used in the drawings is shown below.

10 paper carrying unit, 11A paper insert opening, 11B roll paper insert opening, 13 paper supply roller, 14 platen, 15 paper feed motor (PF motor), 16 paper feed motor driver (PF motor driver), 17A paper feed roller, 17B paper discharge rollers, 18A and 18B free rollers, 20 ink ejection unit, 21 head, 22 head driver, 30 cleaning unit, 31 pump device, 32 pump motor, 33 pump motor driver, 35 capping device, 40 carriage unit, 41 carriage, 42 carriage motor (CR motor), 43 carriage motor driver (CR motor driver), 44 pulley, 45 timing belt, 46 guide rail, 50 measuring instrument group, 51 linear encoder, 511 linear scale, 512 detecting section, 512A light emitting diode, 512B collimator lens, 512C detection processing section, 512D photodiodes, 512E signal processing circuit, 512F comparators, 52 rotary encoder, 53 paper detection sensor, 54 paper width sensor, 60 control unit, 61 CPU, 62 timer, 63 interface section, 64 ASIC, 65 memory, 66 DC controller, 67 host computer, 80 guide unit, 81 fixed guide, 82 movable guide

BEST MODE FOR CARRYING OUT THE INVENTION

At least the following matters will be made clear by the present specification and the description of the accompanying drawings.

A printing apparatus that forms a row of dots from a print start position in a scanning direction to print on a medium to be printed, comprises: a sensor that is capable of detecting an edge, in the scanning direction, of the medium to be printed, wherein the print start position is determined based on a result of detecting the edge of another medium to be printed. With such a printing apparatus, it is possible to provide the print start position at an appropriate position, as well as to shorten the time required for printing.

In the printing apparatus, it is desirable that the result of detecting the edge of the other medium to be printed is stored; and that when printing on the medium to be printed, the stored detection result is read out, and the print start position is determined based on that detection result. With such a printing apparatus, the print start position is determined based on stored information, and thus it is not necessary to detect the edge every time printing is performed, and time required for printing can be shortened.

In the printing apparatus, it is desirable that the sensor is provided on a carriage that is movable in the scanning direction. It is also preferable that the print start position is determined based on information about a position of the carriage for when the sensor detected the edge of the other medium to be printed. It is also preferable that the position of the carriage is detected using an encoder. With such a printing apparatus, it is possible to detect the position of the edge of the medium to be printed based on the position of the carriage.

In the printing apparatus, it is desirable that the information about the position of the carriage for when the sensor detected the edge of the other medium to be printed is stored; that when printing on the medium to be printed, the information about the position of the carriage that has been stored is read out; and that the print start position is determined based on the information about the position of the carriage that has been read out. With such a printing apparatus, the print start position is determined based on the stored carriage position, and thus it is not necessary to detect the position of the edge every time printing is performed, and time required for printing can be shortened.

In the printing apparatus, it is desirable that information about a relative positional relationship between the edge of the medium to be printed and the print start position is obtained; and that the print start position is determined based on this information and the result of detecting the edge. Furthermore, it is preferable that the information about the relative positional relationship between the edge of the medium to be printed and the print start position is information about a blank space that is to be formed on the medium to be printed.

In the printing apparatus, it is desirable that information about the medium to be printed is obtained; and that the print start position is determined based on the information about the medium to be printed and the result of detecting the edge. It is also preferable that the information about the medium to be printed is information about a width of the medium to be printed.

Furthermore, in the printing apparatus, it is preferable that printing is carried out on an entire surface of the medium to be printed; and that the print start position is a position in the scanning direction that is outside of or on the edge of the medium to be printed.

With such a printing apparatus, when performing so-called borderless printing, it is possible to provide the print start position at an appropriate position as well as to shorten the time required for printing.

A printing apparatus that forms a row of dots from a print start position in a scanning direction to print on a medium to be printed, comprises: a sensor that is capable of detecting an edge, in the scanning direction, of the medium to be printed; wherein the sensor is provided on a carriage that is movable in the scanning direction; wherein a position of the carriage is detected using an encoder; wherein information about the position of the carriage for when the edge of the other medium to be printed was detected is stored; wherein at least one of information about a width of the medium to be printed and information about a blank space that is to be formed on the medium to be printed is obtained; wherein when printing on the medium to be printed, the information about the position of the carriage is read out; and wherein the print start position is determined based on the information about the position of the carriage, and at least one of the information about the width of the medium to be printed and the information about the blank space that is to be formed on the medium to be printed. With such a printing apparatus, it is possible to provide the print start position at an appropriate position as well as to shorten the time required for printing.

Furthermore, a program causes a printing apparatus that forms a row of dots from a print start position in a scanning direction to print on a medium to be printed, to achieve: a function of detecting an edge, in the scanning direction, of the medium to be printed; and a function of determining the print start position based on a result of detecting the edge of another medium to be printed. With such a program, it is possible to control the printing apparatus such that it provides the print start position at an appropriate position, as well as shortens the time required for printing.

Furthermore, it is also possible to provide a computer-readable storage medium containing codes for causing a printing apparatus that forms a row of dots from a print start position in a scanning direction to print on a medium to be printed, to achieve: a function of detecting an edge, in the scanning direction, of the medium to be printed; and a function of determining the print start position based on a result of detecting the edge of another medium to be printed.

Furthermore, a printing method for printing on a medium to be printed, comprises: a step of detecting an edge, in a scanning direction, of another medium to be printed; a step of determining a print start position based on a result of detecting the edge of the other medium to be printed; and a step of ejecting ink droplets, in the scanning direction, from the determined print start position to print on a medium to be printed that is different from the other medium to be printed.

Furthermore, a computer system comprises a main computer unit and a printing apparatus, forms a row of dots from a print start position in a scanning direction to print on a medium to be printed, and is provided with a sensor that is capable of detecting an edge, in the scanning direction, of the medium to be printed, wherein the print start position is determined based on a result of detecting the edge of another medium to be printed. With such a computer system, it is possible to provide the print start position at an appropriate position, as well as to shorten the time required for printing.

===Overview of Printing Apparatus (Inkjet Printer)===

<Regarding the Configuration of the Inkjet Printer>

Figure 2:
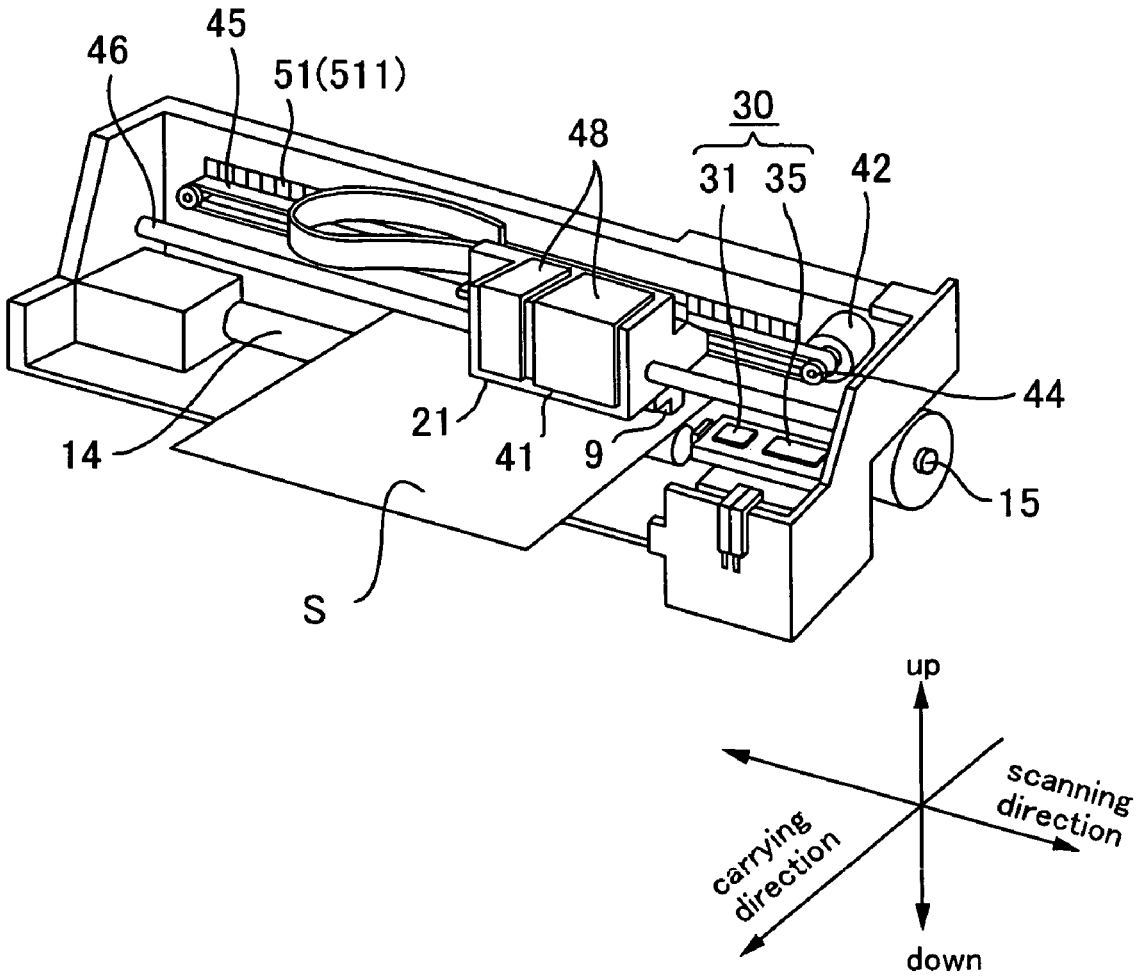
FIG. 2 is a diagram that schematically shows an area around a carriage of the inkjet printer of the present embodiment.
Figure 3:
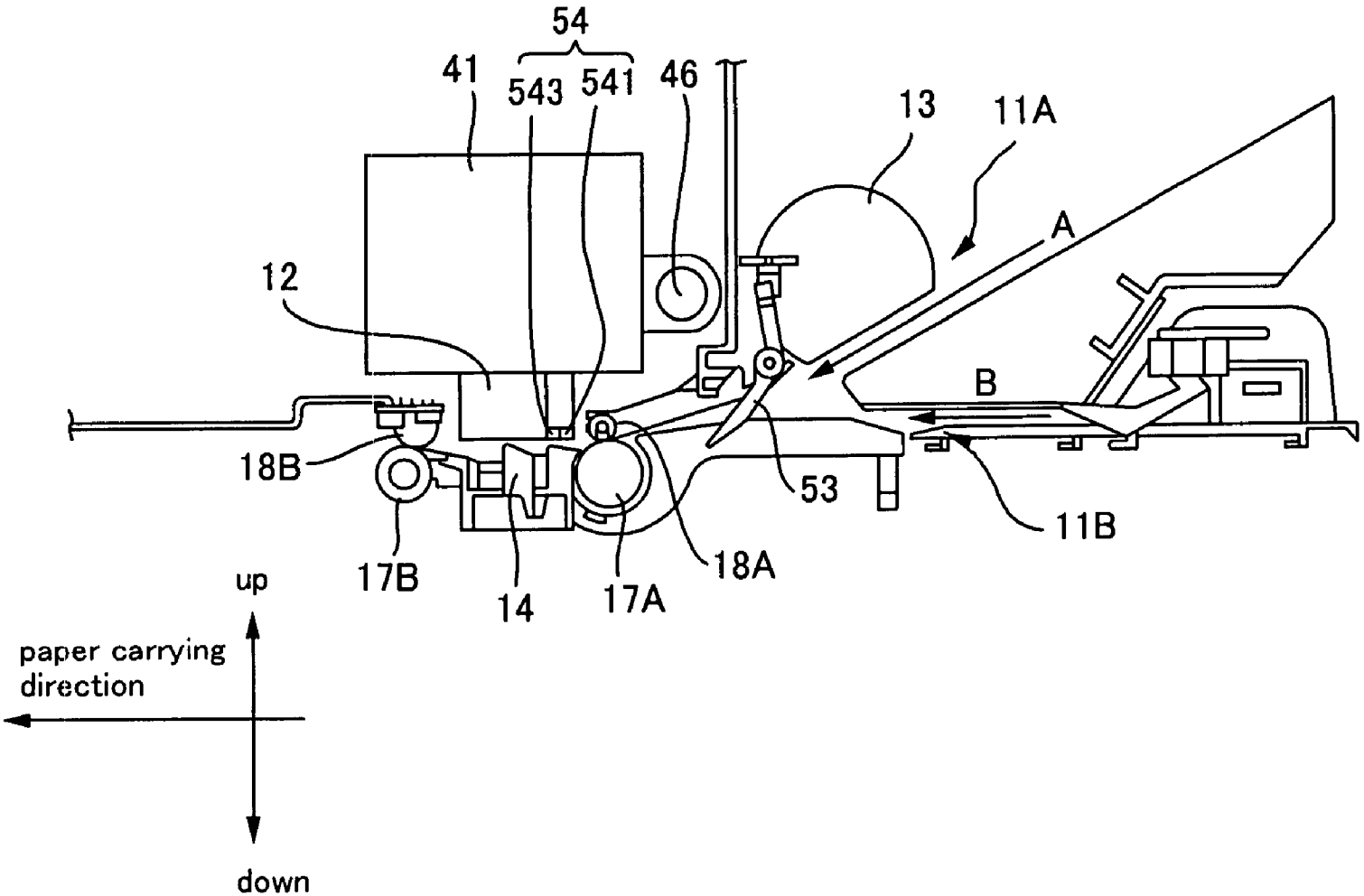
FIG. 3 is an explanatory diagram of an area around a carrying unit of the inkjet printer of the present embodiment.
Figure 4:
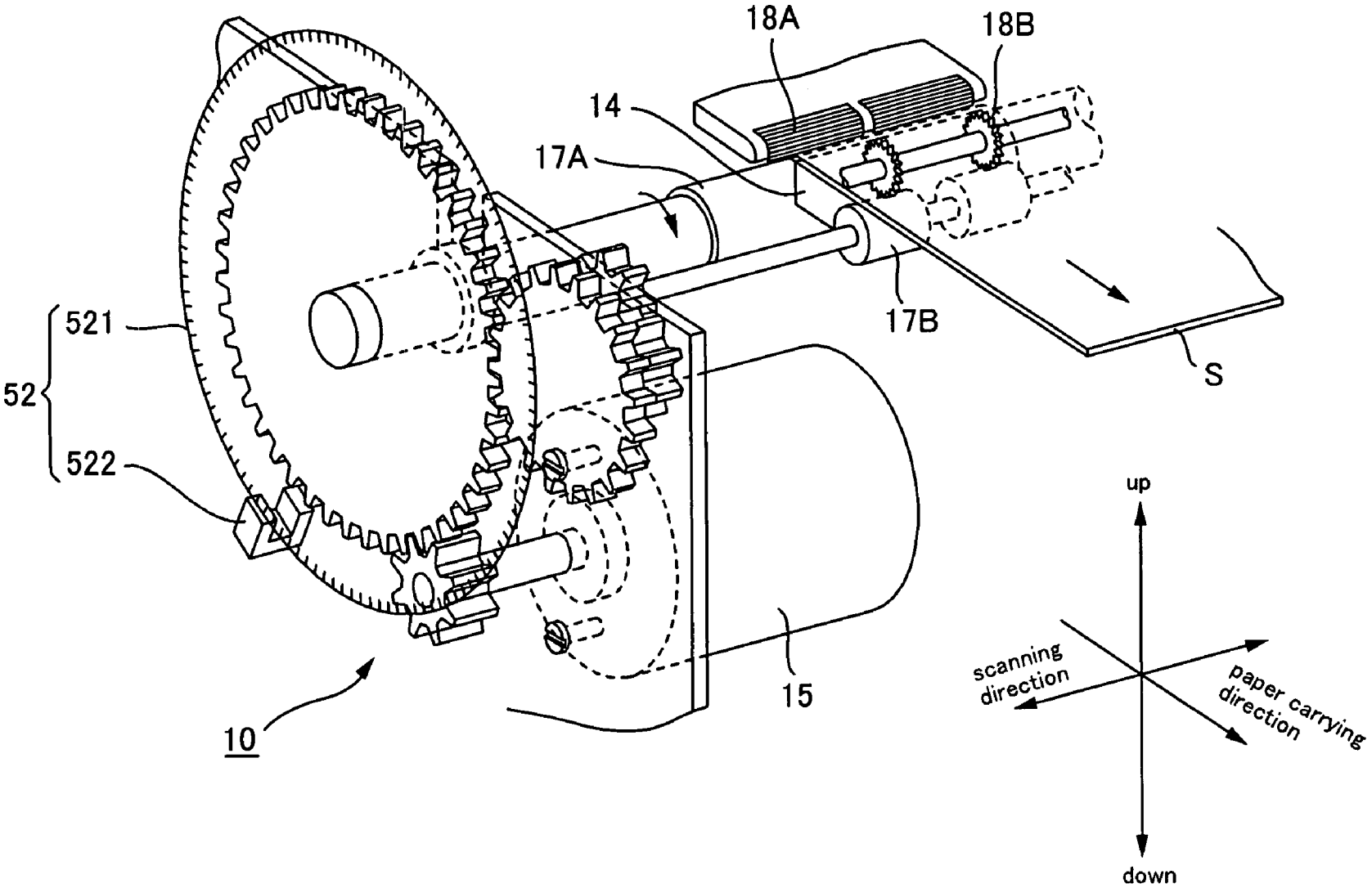
FIG. 4 is a perspective view of the area around the carrying unit of the inkjet printer of the present embodiment.

An overview of an inkjet printer serving as an example of a printing apparatus is described with reference to FIG. 1, FIG. 2, FIG. 3, and FIG. 4. It should be noted that FIG. 1 is an explanatory diagram of the overall configuration of an inkjet printer of the present embodiment. FIG. 2 is a schematic diagram of an area around the carriage of the inkjet printer of the present embodiment. FIG. 3 is an explanatory diagram of an area around the carrying unit of the inkjet printer of the present embodiment. FIG. 4 is a perspective view of an area around the carrying unit of the inkjet printer of the present embodiment.

The inkjet printer of the present embodiment has a paper carrying unit 10, an ink ejection unit 20, a cleaning unit 30, a carriage unit 40, a measuring instrument group 50, and a control unit 60.

The paper carrying unit 10 is for feeding paper, which is an example of a medium to be printed, into a printable position and making the paper move in a predetermined direction (the direction perpendicular to the paper face in FIG. 1 (hereinafter, this is referred to as the paper carrying direction)) by a predetermined movement amount during printing. In other words, the paper carrying unit 10 functions as a carrying mechanism for carrying paper. The paper carrying unit 10 has a paper insert opening 11A and a roll paper insert opening 11B, a paper supply motor (not shown), a paper supply roller 13, a platen 14, a paper feed motor (hereinafter, referred to as "PF motor") 15, a paper feed motor driver (hereinafter, referred to as "PF motor driver") 16, a paper feed roller 17A and paper discharge rollers 17B, and free rollers 18A and free rollers 18B. However, the paper carrying unit 10 does not necessarily have to include all of these structural elements in order to function as a carrying mechanism.

The paper insert opening 11A is where paper, which is the medium to be printed, is inserted. The roll paper insert opening 11B is where roll paper is inserted. The paper supply motor (not shown) is a motor for carrying the paper that has been inserted into the paper insert opening 11A into the printer, and is constituted by a pulse motor. The paper supply roller 13 is a roller for automatically carrying the paper that has been inserted into the paper insert opening 11A into the printer, and is driven by the paper supply motor 12. The paper supply roller 13 has a transverse cross-sectional shape that is substantially the shape of the letter D. The peripheral length of a circumference section of the paper supply roller 13 is set longer than the carrying distance to the PF motor 15, so that using this circumference section the medium to be printed can be carried up to the PF motor 15. It should be noted that a plurality of media to be printed are kept from being supplied at one time by the rotational drive force of the paper supply roller 13 and the frictional resistance of separating pads (not shown). The sequence through which the medium to be printed is carried is described in detail later.

The platen 14 supports the paper S during printing. The PF motor 15 is a motor for feeding paper, which is an example of a medium to be printed, in the paper carrying direction, and is constituted by a DC motor. The PF motor driver 16 is for driving the PF motor 15. The paper feed roller 17A is a roller for feeding the paper S that has been carried into the printer by the paper supply roller 13 to a printable region, and is driven by the PF motor 15. The free rollers 18A are provided in a position that is in opposition to the paper feed roller 17A, and push the paper S toward the paper feed roller 17A by sandwiching the paper S between them and the paper feed roller 17A.

The paper discharge rollers 17B are rollers for discharging the paper S for which printing has finished to outside the printer. The paper discharge rollers 17B are driven by the PF motor 15 through a gear wheel that is not shown in the drawings. The free rollers 18B are provided in a position that is in opposition to the paper discharge rollers 17B, and push the paper S toward the paper discharge rollers 17B by sandwiching the paper S between them and the paper discharge rollers 17B.

The ink ejection unit 20 is for ejecting ink onto paper, which is an example of the medium to be printed. The ink ejection unit 20 has a head 21 and a head driver 22. The head 21 has a plurality of nozzles, which are ink ejection sections, and ejects ink intermittently from each of the nozzles. The head driver 22 is for driving the head 21 so that ink is ejected intermittently from the head.

The cleaning unit 30 is for preventing the nozzles of the head 21 from becoming clogged. The cleaning unit 30 has a pump device 31 and a capping device 35. The pump device is for extracting ink from the nozzles in order to prevent the nozzles of the head 21 from becoming clogged, and has a pump motor 32 and a pump motor driver 33. The pump motor 32 sucks out ink from the nozzles of the head 21. The pump motor driver 33 drives the pump motor 32. The capping device 35 is for sealing the nozzles of the head 21 when printing is not being performed (during standby) so that the nozzles of the head 21 are kept from clogging.

The carriage unit 40 is for making the head 21 scan and move in a predetermined direction (in FIG. 1, the left and right direction of the paper face (hereinafter, this is referred to as the scanning direction)). The carriage unit 40 has a carriage 41, a carriage motor (hereinafter, referred to as CR motor) 42, a carriage motor driver (hereinafter, referred to as CR motor driver) 43, a pulley 44, a timing belt 45, and a guide rail 46. The carriage 41 is movable in the scanning direction, and the head 21 is fastened to it (thus, the nozzles of the head 21 intermittently eject ink as they are moved in the scanning direction). The carriage 41 also removably holds ink cartridges 48 that contain ink. The CR motor 42 is a motor for moving the carriage in the scanning direction, and is constituted by a DC motor. The CR motor driver 43 is for driving the CR motor 42. The pulley 44 is attached to the rotation shaft of the CR motor 42. The timing belt 45 is driven by the pulley 44. The guide rail 46 is for guiding the carriage 41 in the scanning direction.

The measuring instrument group 50 includes a linear encoder 51, a rotary encoder 52, a paper detection sensor 53, and a paper width sensor 54. The linear encoder 51 is for detecting the position of the carriage 41. The rotary encoder 52 is for detecting the amount of rotation of the paper feed roller 17A. It should be noted that the configuration, for example, of the encoders is discussed later. The paper detection sensor 53 is for detecting the position of the front end of the paper to be printed. The paper detection sensor 53 is provided in a position where it can detect the position of the front end of the paper as the paper is being carried toward the paper feed roller 17A by the paper supply roller 13. It should be noted that the paper detection sensor 53 is a mechanical sensor that detects the front end of the paper through a mechanical mechanism. More specifically, the paper detection sensor 53 has a lever that can be rotated in the paper carrying direction, and this lever is arranged so that it protrudes into the path over which the paper is carried. In this way, the front end of the paper comes into contact with the lever and the lever is rotated, and thus the paper detection sensor 53 detects the position of the front end of the paper by detecting the movement of the lever. The paper width sensor 54 is attached to the carriage 41. The paper width sensor 54 is an optical sensor having a light-emitting section 541 and a light-receiving section 543, and detects whether the paper is present or not at the position of the paper width sensor 54 by detecting light that is reflected by the paper. The paper width sensor 54 detects the positions of the edges of the paper while being moved by the carriage 41, so as to detect the width of the paper. The paper width sensor 54 can detect the front end of the paper according to the position of the carriage 41. The paper width sensor 54 is an optical sensor, and thus detects positions with higher precision than the paper detection sensor 53.

The control unit 60 is for carrying out control of the printer. The control unit 60 has a CPU 61, a timer 62, an interface section 63, an ASIC 64, a memory 65, and a DC controller 66. The CPU 61 is for carrying out the overall control of the printer, and sends control commands to the DC controller 66, the PF motor driver 16, the CR motor driver 43, the pump motor driver 32, and the head driver 22. The timer 62 periodically generates interrupt signals with respect to the CPU 61. The interface section 63 exchanges data with a host computer 67 provided outside the printer. The ASIC 64 controls the print resolution and the drive waveforms of the head, for example, based on print information sent from the host computer 67 through the interface section 63. The memory 65 is for reserving an area for storing the programs for the ASIC 64 and the CPU 61 and a work area, for instance, and has storage means such as a RAM or an EEPROM. The DC controller 66 controls the PF motor driver 16 and the CR motor driver 43 based on control commands sent from the CPU 61 and the output from the measuring instrument group 50.

<Regarding the Configuration of the Encoders>

FIG. 5 is an explanatory diagram of the linear encoder 51.

The linear encoder 51 is for detecting the position of the carriage 41, and has a linear scale 511 and a detecting section 512.

The linear scale 511 is provided with slits at a predetermined spacing (for example, every 1/180 inch (1 inch equals 2.54 cm)), and is fastened to the body of the printer.

The detecting section 512 is provided in opposition to the linear scale 511, and is on the carriage 41 side. The detecting section 512 has a light-emitting diode 512A, a collimator lens 512B, and a detection processing section 512C. The detection processing section 512C is provided with a plurality (for instance, four) photodiodes 512D, a signal processing circuit 512E, and two comparators 512Fa and 512Fb.

The light-emitting diode 512A emits light when a voltage Vcc is applied to it via resistors on both sides, and this light is incident on the collimator lens. The collimator lens 512B turns the light that is emitted from the light-emitting diode 512A into parallel light, and irradiates the parallel light on the linear scale 511. The parallel light that passes through the slits provided in the linear scale then passes through stationary slits (not shown) and is incident on the photodiodes 512D. The photodiodes 512D convert the incident light into electric signals. The electric signals that are output from the photodiodes are compared in the comparators 512Fa and 512Fb, and the results of these comparisons are output as pulses. Then, the pulse ENC-A and the pulse ENC-B that are output from the comparators 512Fa and 512Fb become the output of the linear encoder 51.

FIG. 6A and FIG. 6B are timing charts showing two types of output signal waveforms of the linear encoder 51, and more specifically, FIG. 6A is a timing chart of the output signal waveform when the CR motor 42 is rotating forward, and FIG. 6B is a timing chart of the output signal when the CR motor 42 is rotating in reverse.

As shown in FIG. 6A and FIG. 6B, the phases of the pulse ENC-A and the pulse ENC-B are misaligned by 90 degrees both when the CR motor 42 is rotating forward and when it is rotating in reverse. When the CR motor 42 is rotating forward, that is, when the carriage 41 is moving in the main-scanning direction, then, as shown in FIG. 6A, the phase of the pulse ENC-A leads the phase of the pulse ENC-B by 90 degrees. On the other hand, when the CR motor 42 is rotating in reverse, then, as shown in FIG. 6B, the phase of the pulse ENC-A trails the phase of the pulse ENC-B by 90 degrees. A single period T of the pulses is equivalent to the time during which the carriage 41 is moved by the spacing of a slit in the linear scale 511 (for example, by 1/180 inch (1 inch equals 2.54 cm)).

The position of the carriage 41 is detected as follows. First, the rising edge or the falling edge of either the pulse ENC-A or ENC-B is detected, and the number of detected edges is counted. The position of the carriage 41 is calculated based on the counted number. As regards the counted number, when the CR motor 42 is rotating forward, a "+1" is added for each detected edge, and when the CR motor 42 is rotating in reverse, a "−1" is added for each detected edge. Since the period of the pulses ENC is equal to the slit spacing of the linear scale 511, the amount that the carriage 41 has moved from a position where the count number is "0" can be found by multiplying the counted number by the slit spacing. In other words, the resolution of the linear encoder 51 in this case is the slit spacing of the linear scale 511. It is also possible to detect the position of the carriage 41 using both the pulse ENC-A and the pulse ENC-B. The periods of the pulse ENC-A and the pulse ENC-B are equal to the slit spacing of the linear scale 511, and the phases of the pulses ENC-A and ENC-B are misaligned by 90 degrees, so that if the rising edges and the falling edges of the pulses are detected and the number of detected edges is counted, then a counted number of "1" corresponds to ¼ of the slit spacing of the linear scale 511. Therefore, by multiplying the counted number by ¼ of the slit spacing, the amount that the carriage 41 has moved from a position where the count number is "0" can be found. That is, the resolution of the linear encoder 51 in this case is ¼ the slit spacing of the linear scale 511.

The velocity Vc of the carriage 41 is detected as follows. First, the rising edges or the falling edges of either the pulse ENC-A or ENC-B are detected. The time interval between edges of the pulses is counted with a timer counter. The period T (T=T1, T2, . . . ) is obtained from the value that is counted. If λ (lambda) is the slit spacing of the linear scale 511, then the velocity of the carriage can be sequentially obtained as λ/T. It is also possible to detect the velocity of the carriage 41 using both the pulse ENC-A and the pulse ENC-B. By detecting the rising edges and the falling edges of the pulses, the time interval between edges, which corresponds to ¼ of the slit spacing of the linear scale 511, is counted by the timer counter. The period T (T=T1, T2, . . . ) is obtained from the value that is counted. If λ is the slit spacing of the linear scale 511 then the velocity Vc of the carriage can be found sequentially as Vc=λ/(4T).

It should be noted that the rotary encoder 52 has substantially the same configuration as the linear encoder 51, except that a rotation disk 521 that rotates in accordance with rotation of the paper feed roller 17A is used in place of the linear scale 511 that is provided on the body of the printer, and that a detecting section 522 that is provided on the body of the printer is used in place of the detecting section 512 that is provided on the carriage 41 (see FIG. 4).

It should be noted that what the rotary encoder 52 directly detects is the rotation amount of the paper feed roller 17A, and it is not the carry amount of the paper. When the paper feed roller 17A is rotated to carry the paper, a carry error occurs due to slippage between the paper feed roller 17A and the paper. Consequently, the rotary encoder 52 cannot directly detect the carry error of the carry amount of the paper. Accordingly, a table that expresses the relationship between the rotation amount detected by the rotary encoder 52 and the carry error is created and stored in the memory 65 of the control unit 60. Then, the table is referenced based on the results detected by the rotary encoder, and the carry error is thereby detected. This table is not limited to expressing the relationship between the rotation amount and the carry error, and may also be a table that expresses the relationship between the number of times of carries, for example, and the carry error. Also, because slippage differs depending on the characteristics of the paper, it is also possible to create a plurality of tables corresponding to the paper characteristics and to store these in the memory 65.

<Regarding the Configuration of the Nozzles>

Figure 7:
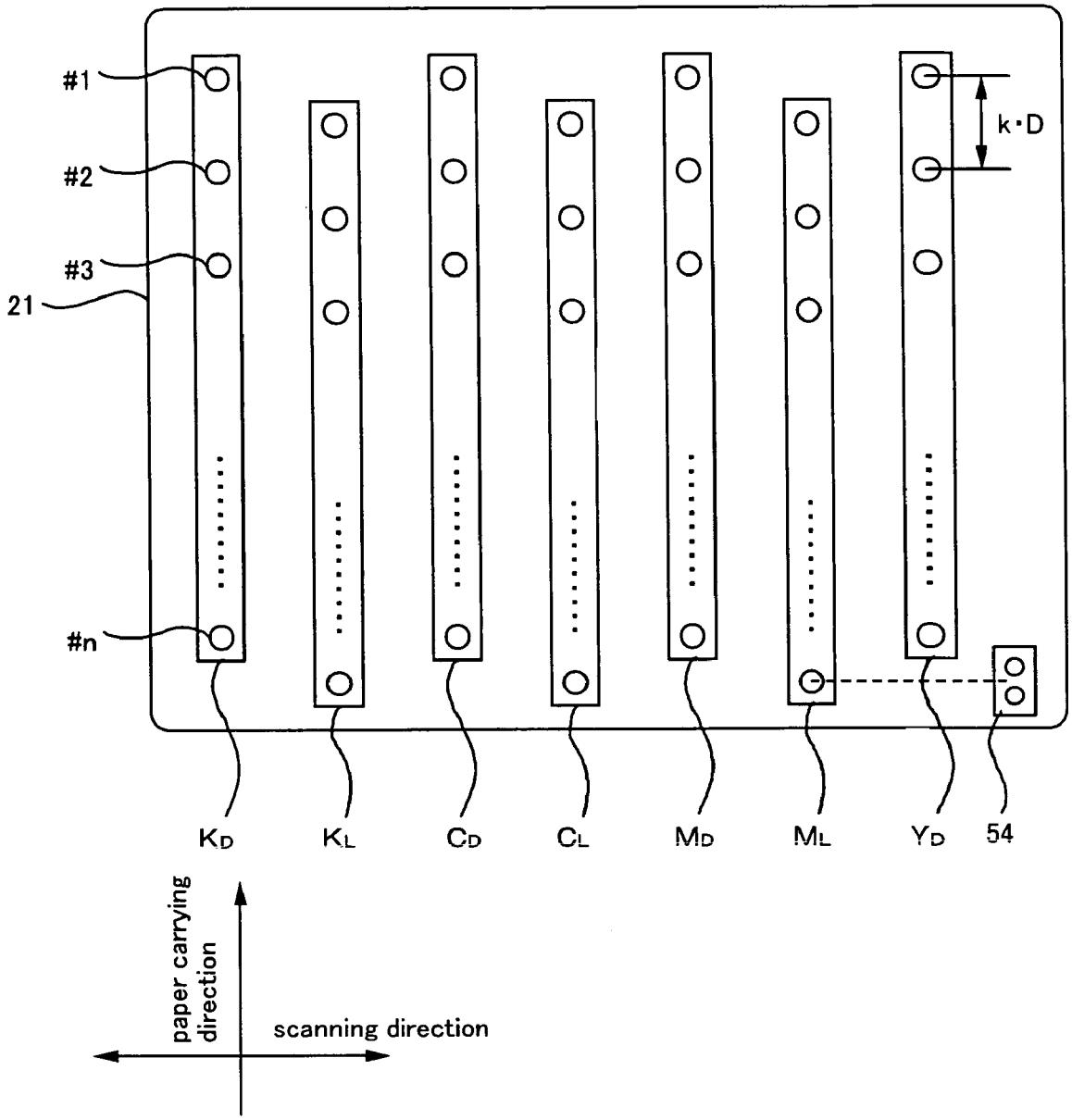
FIG. 7 is an explanatory diagram showing the arrangement of the nozzles.

FIG. 7 is an explanatory diagram showing the arrangement of the nozzles in the lower surface of the head 21. In the lower surface of the head 21 there are formed a dark black ink nozzle group KD, a light black ink nozzle group KL, a dark cyan ink nozzle group CD, a light cyan ink nozzle group CL, a dark magenta ink nozzle group MD, a light magenta nozzle group ML, and a yellow ink nozzle group YD. Each nozzle group is provided with a plurality (in the present embodiment, n pieces) of nozzles, which are ejection openings for ejecting the respective colors of ink. It should be noted that the first alphabet letter in the reference characters indicating the nozzle groups represents the ink color, whereas the accompanying letter "D" means that the ink has a relatively high darkness and the accompanying letter "L" means that the ink has a relatively low darkness.

The plurality of nozzles of the nozzle groups are arranged at a constant spacing (nozzle pitch: k·D) in the paper carrying direction. Here, D is the minimum dot pitch in the paper carrying direction (that is, the spacing at the highest resolution of the dots formed on the paper S). Also, k is an integer of 1 or more.

The nozzles of the nozzle groups are assigned numbers that become smaller toward the downstream side (#1 to #n). Also, as regards their positions in the paper carrying direction, the nozzles of each nozzle group are provided so that they are positioned between the nozzles of adjacent nozzle groups. For example, the first nozzle #1 of the light black ink nozzle group KL is provided between the first nozzle #1 and the second nozzle #2 of the dark black ink nozzle group KD, as regards its position in the paper carrying direction. Further, the paper width sensor 54 is provided substantially in the same position as the n-th nozzle #n furthest downstream, as regards its position in the paper carrying direction. Each nozzle is provided with a piezo element (not shown) as a drive element for driving the nozzle and making it eject ink droplets.

During printing, the paper S is carried intermittently by the paper carrying unit 10 by a predetermined carry amount, and between these intermittent carries, the carriage 41 is moved in the main-scanning direction and ink droplets are ejected from the nozzles.

===Detecting the Edges of the Paper===

In the present embodiment, the paper width sensor 54 detects the distance PG to the paper, and depending on the distance PG, detects the presence or absence of paper in the detection position. Then, by detecting the presence or absence of paper in the scanning direction, the paper width sensor 54 detects both edges of the paper to detect the width of the paper.

Figure 8:
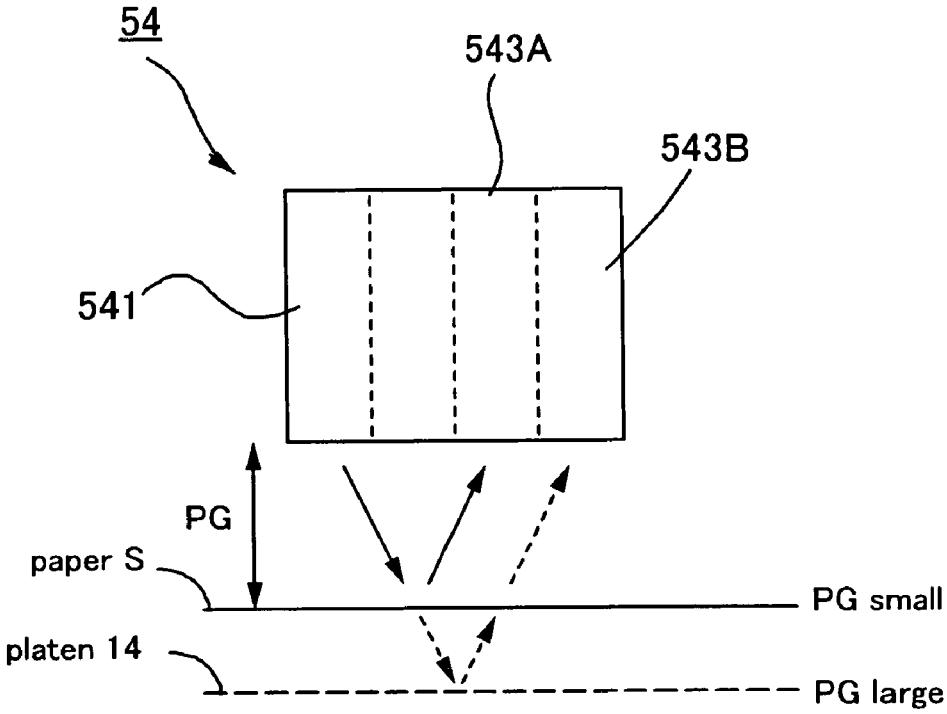
FIG. 8 is an explanatory diagram of a paper width sensor.

FIG. 8 is an explanatory diagram of the paper width sensor 54 that detects the distance PG. It should be noted that as can be seen from the figure, the paper width sensor 54 functions as a gap sensor.

In the figure, the paper width sensor 54 has a light-emitting section 541 and two light-receiving sections (a first light-receiving section 543A and a second light-receiving section 543B). The light-emitting section 541 contains a light emitting diode, and irradiates light onto the paper S, which is the medium to be printed. The first light-receiving section 543A has a light-receiving element that outputs an electric signal that depends on the amount of light received. The second light-receiving section 543B has a light-receiving element, like the first light-receiving section 543A. The second light receiving element 543B is provided in a position further from the light-emitting section compared to the first light-receiving section 543A.

The light that is emitted from the light-emitting section 541 is incident on the paper S. The light that is incident on the paper S is reflected by the paper. The light that is reflected by the paper S is incident on the light-receiving elements. The light that is incident on the light-receiving elements is converted by the light-receiving elements to electric signals that depend on the amount of light that is incident.

If the paper S is on the platen 14, then the distance PG is small. Consequently, the light that is reflected by the paper S is principally incident on the first light-receiving section 543A, and only diffused light is incident on the second light-receiving section 543B. Consequently, the output signal of the first light-receiving section 543A becomes larger than the output signal from the second light-receiving section 543B.

On the other hand, when the paper S is not on the platen 14, the distance PG is large. Consequently, the light that is reflected by the platen is principally incident on the second light-receiving section 543B, and only diffused light is incident on the first light-receiving section 543A. Consequently, the output signal of the second light-receiving section 543B becomes larger than the output signal from the first light-receiving section 543A.

Consequently, if the relationship between the output signal ratios of the two light-receiving sections and the distance PG (or the presence or absence of paper) is determined in advance, then based on the ratio of the output signals of the light-receiving sections, it is possible to detect the presence or absence of paper at the detection position. In this case, information about the relationship between the ratio of the output signals of light-receiving sections and the distance PG (or the presence or absence of paper) can be stored in the memory 65 as a table.

Figure 9:
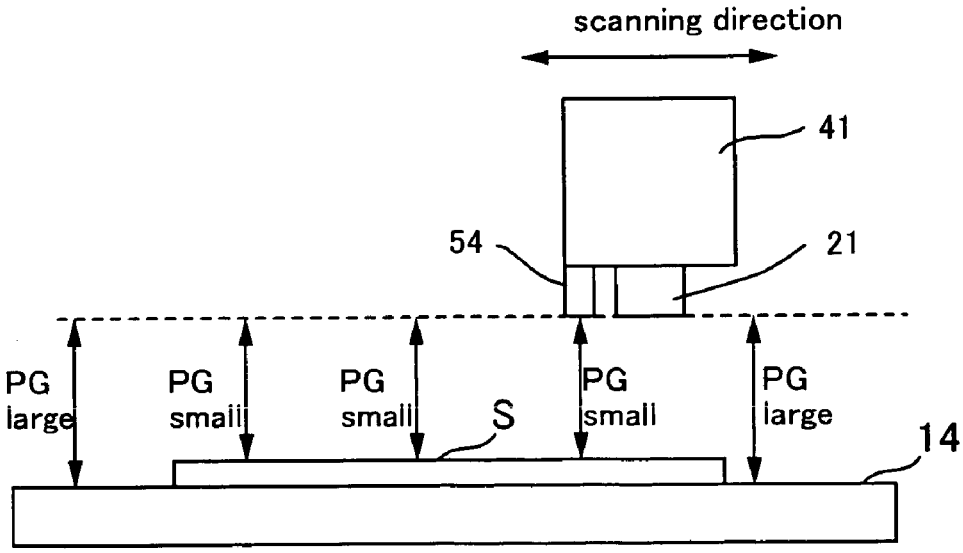
FIG. 9 is an explanatory diagram showing the paper width sensor measuring at a plurality of locations in the scanning direction.

FIG. 9 is an explanatory diagram showing the paper width sensor 54 measuring the distance PG at a plurality of locations in the scanning direction. In the figure, identical structural components have been assigned same reference numerals, and thus description thereof is omitted.

In the figure, the paper width sensor 54 is provided on the carriage 41. Consequently, the paper width sensor 54 is capable of moving in the scanning direction when the carriage moves. Thus the paper width sensor 54 can detect the distance PG at a plurality of locations in the scanning direction.

On the other hand, the position of the carriage 41 in the scanning direction can be detected by the linear encoder 51 as noted above. That is to say, the position at which the distance PG is measured by the paper width sensor 54 is detected by the linear encoder 51.

Thus, by detecting the position of the carriage for when the distance PG, which is detected by the paper width sensor 54, changes, it is possible to detect the edge of the paper. It should be noted that by detecting both edges of the paper, it is possible to detect the width of the paper.

===Guide Unit===

Figure 10:
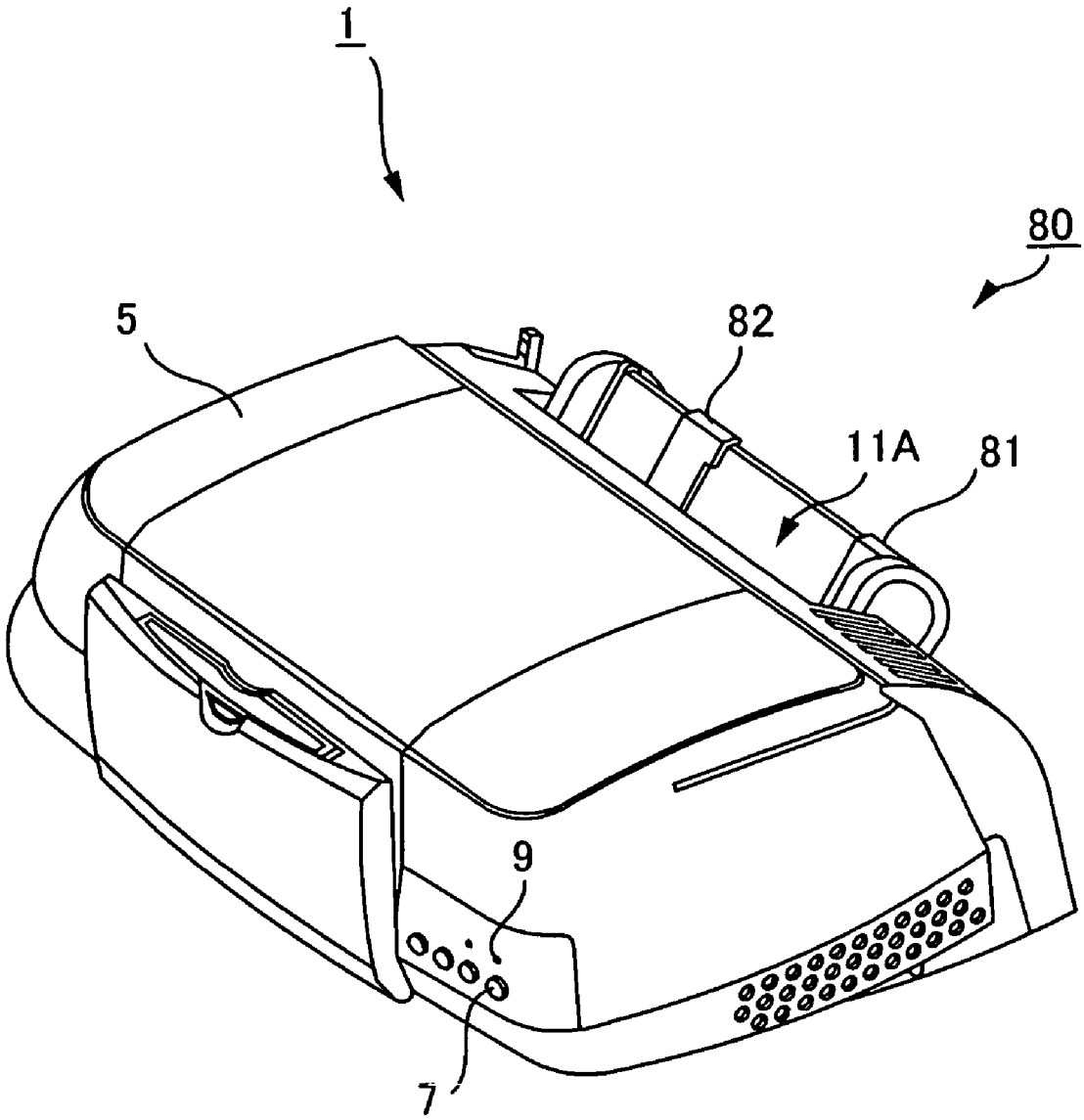
FIG. 10 is a perspective view of the entire printer and a guide unit.

FIG. 10 is a perspective view showing the overall printer and a guide unit.

In addition to the structural elements noted above, the printer 1 has a housing 3, an upper lid 5, an operation section 7 and a display section 9. The housing 3 is a box containing the above noted structural elements (for example, elements such as the paper carrying unit 10, the ink ejection unit 20, the cleaning unit 30, the carriage unit 40, the measuring instrument group 50 and the control unit 60 and the like). The upper lid 5 is a lid that is capable of rotating in an open/close direction about a rotation shaft (not shown) provided on the housing 3. When the upper lid 5 is opened, the paper carrying unit 10 and the carriage unit 40, for example, that are contained in the housing 3 can be seen. The upper lid 5 is opened and closed at times such as when changing a cartridge or when the paper is jammed, for example. The operation section 7 is provided on the housing 3, and has buttons. By operating the buttons, the user can perform various settings of the printer 1. The display section 9 is provided on the housing 3, and has lamps. It is possible to, for example, confirm the operations of the printer 1 in accordance with flashing of the lamps. It should be noted that the display section 9 may also be a liquid crystal display panel instead of lamps.

A guide unit 80 is arranged to support the posture of the paper when the paper S is supplied into the printer from the paper insert opening 11A. The guide unit 80 is provided with a fixed guide 81 and a movable guide 82. The fixed guide 81 is mounted integrally with the body of the printer, and has a guide face that is perpendicular to the scanning direction. When the paper S is supplied from the paper insert opening 11A, the fixed guide 81 contacts the side edge of the paper with the guide face, and when the paper is carried, it guides the paper S in the carrying direction. The movable guide 82 is provided such that it is capable of moving in the scanning direction with respect to the body of the printer, and has a guide face that is perpendicular to the scanning direction. It is possible to change the position of the movable guide 82 in the scanning direction so as to be able to set paper of various sizes. One edge of the paper is made to contact the fixed guide, and the other edge of the paper is made to contact the movable guide 82. By confining the edges of the paper with the fixed guide and the movable guide, it is possible to suppress skewing of the paper when the paper is being supplied.

===Determining the Print Staff Position===

<Regarding the Print Start Position>

Figure 11:
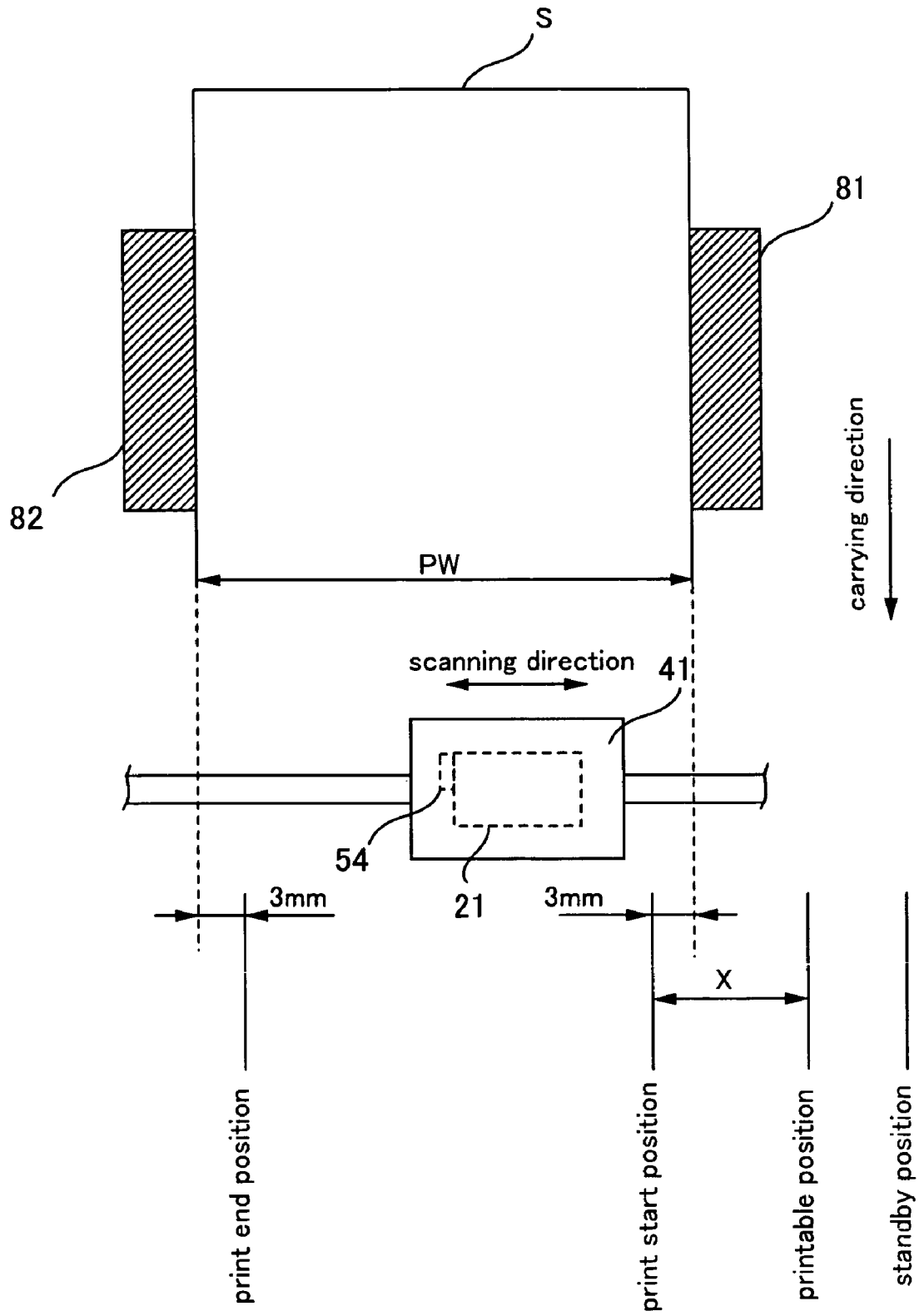
FIG. 11 is a diagram for explaining a print start position.

FIG. 11 is a diagram for describing the print staff position. In this figure, structural elements that have already been described are assigned identical reference numerals, and thus description thereof is omitted. It should be noted that in the figure, the edges of the paper S are confined by the fixed guide 81 and the movable guide 82, and the paper is supplied while skewing is suppressed.

In the figure, "standby position" is the position at which the carriage 41 waits when it is not printing, and is referred to as the so-called "home position". The capping device 35 is provided in the vicinity of this position. When the carriage 41 is in the standby position when it is not printing, the capping device 35 seals the nozzles of the head 21 and prevents the nozzles from clogging. Then, when the carriage 41 that is in the standby position receives a print command, it starts to move in the scanning direction toward the printing region.

A "printable position" is a position at which the nozzles of the head 21 are capable of ejecting ink. However, if, for example, the nozzles start ejecting ink when the carriage 41 is at the printable position, then the ink will land on the platen 14 and soil the platen because there is no paper below the nozzles. If the carriage 41 moves in the scanning direction when the carriage 41 is at the printable position, then pulse signals are output from the linear encoder 51. Consequently, when the carriage 41 is on the printing region side of the printable position (in the figure, the side to the left of the printable position), the control unit 60 can detect the amount that the carriage has moved from the printable position, based on the output signal of the linear encoder 51. It should be noted that when the carriage moves a predetermined amount in the scanning direction, a pulse signal is output from the linear encoder 51, and thus the control unit 60 is able to detect the position of the carriage 41 in the scanning direction in accordance with the count of the pulse signals from the linear encoder 51.

A "print start position" is a position at which the nozzles of the head 21 start to eject ink, and is a position that can be changed depending on the print mode. The figure shows a method in which printing is performed leaving 3 mm of blank space from the edge of the paper S. The print start position is determined by counting the pulse signals output from the linear encoder 51. In the figure, the number of pulses that correspond to a movement amount X from the printable position is counted. It should be noted that the movement amount X is a value that is set in each printer so as to give a predetermined amount of blank space (3 mm) when printing. Setting of the movement amount X is described below.

A "print end position" is a position at which the nozzles of the head 21 stop ejecting ink, and is a position that can be changed depending on the print mode. The figure shows a method in which printing is performed leaving 3 mm of blank space from the edge of the paper S. Consequently, the width of the region that is printed on the paper S is a value that is 6 mm less than a width PW of the paper (PW—6 mm).

It is desirable that the region that is printed on the paper S has equal blank space on its lefi and right side. On the other hand, when printing is performed such that the paper width sensor 54 first detects the positions of both edges of the paper and then determines equal blank spaces on the left and right, an operation for detecting the position of both edges of the paper becomes necessary, and thus, the print operation is delayed.

Thus, in the printer of the present embodiment, the result of detecting the positions of both edges of the paper is not used when starting printing, but rather, printing is started when the carriage is moved by a predetermined movement amount X from the printable position. Thus, the operation of detecting the position of both edges of the paper when starting printing is not required, and thus it is possible to start the printing operation at an earlier timing.

However, if the distance between the printable position and the print start position is fixed for all printers, then as described below, a shift may occur in the printing position, and the blank space on the left and right may become unequal.

Figure 12A:
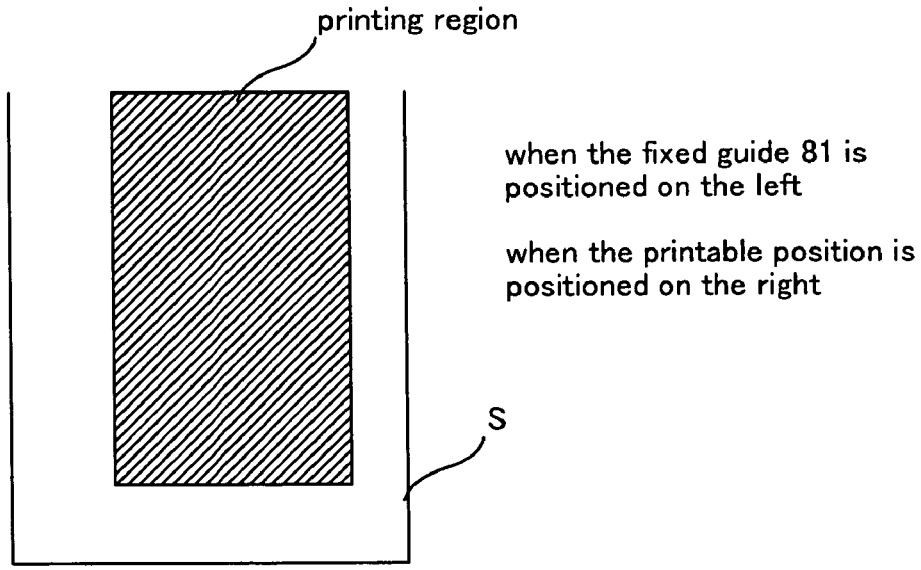
FIG. 12A is an explanatory diagram of when a printing region is shifted to the right side of a piece of paper S.

For example, when the fixed guide 81 is mounted to the left of an ideal mounting position because of a mounting error of the fixed guide, the printing region will be shifted to the right side of the paper S as shown in FIG. 12A, and it is not possible to form equal blank space. Alternatively, if the printable position is positioned to the right side due to a mounting error of the linear encoder, then the printing region will also be shifted to the right side of the paper S.

Figure 12B:
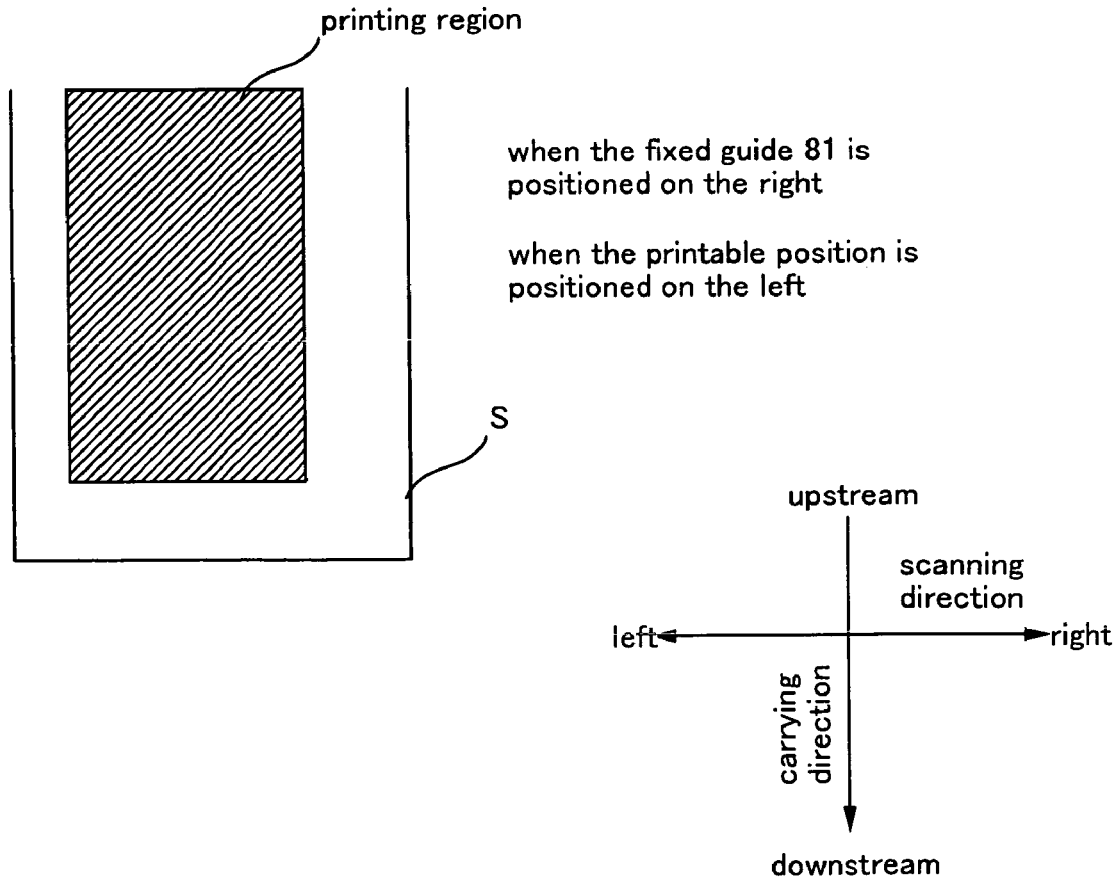
FIG. 12B is an explanatory diagram of when the printing region is shifted to the left side of the paper S.

Furthermore, for example, when the fixed guide 81 is mounted to the right of an ideal mounting position because of a mounting error of the fixed guide, the printing region will be shifted to the left side of the paper S as shown in FIG. 12B, and it is not possible to form equal blank space. Alternatively, if the printable position is positioned to the left side due to a mounting error of the linear encoder, then the printing region will also be shifted to the left side of the paper S.

Consequently, in order to position the printing region in the center of the paper S such that the blank space on the left and right becomes equal, it is necessary to alter the distance X between the printable position and the print start position for each printer.

Thus, in the present embodiment, in order to determine the print start position for each printer, a calibration operation is performed according to the sequence given below.

<Calibration Operation>

Figure 13:
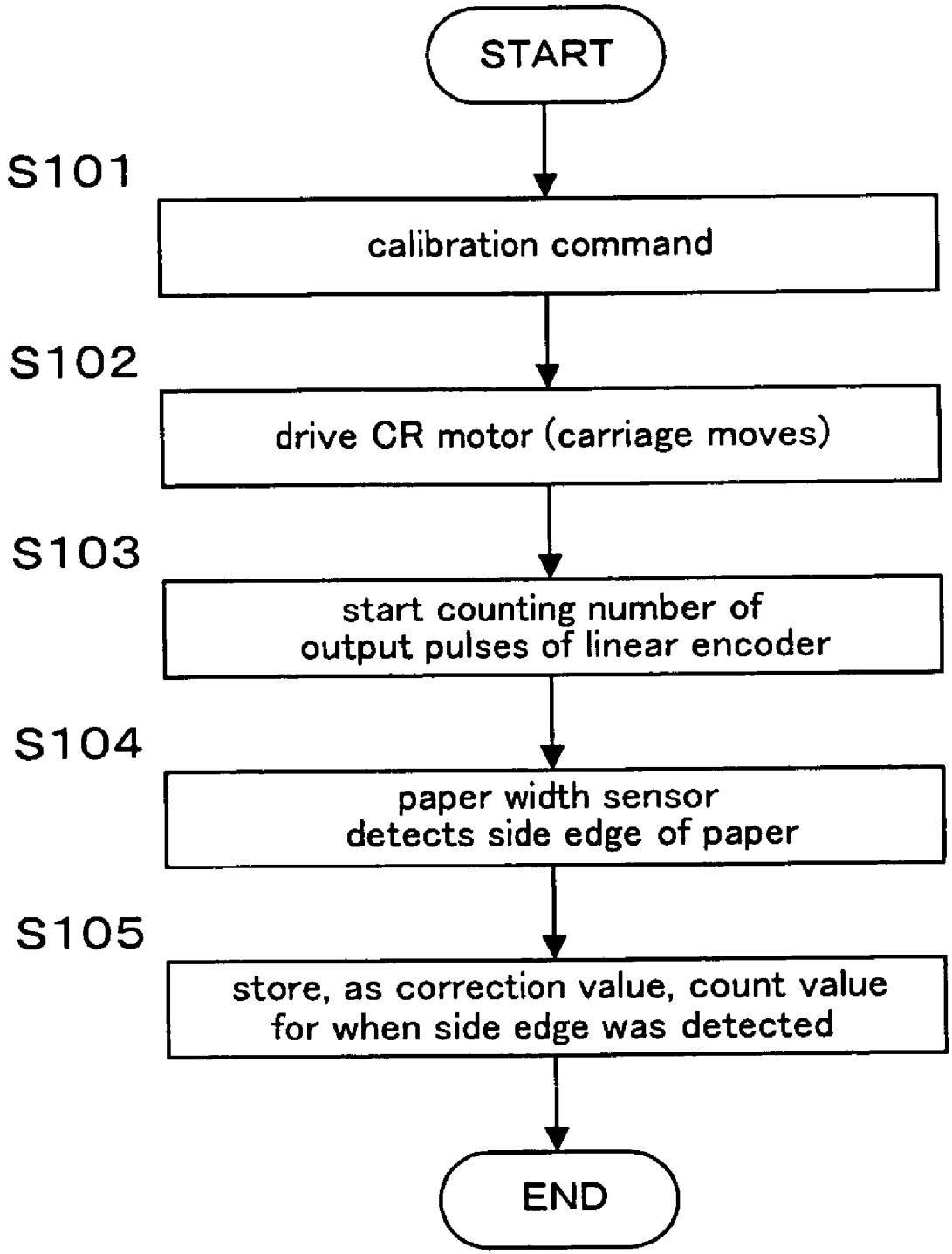
FIG. 13 is a flowchart of a calibration operation.

FIG. 13 is a flowchart of the calibration operation. The calibration operation is performed either before the printer is shipped from the factory, or when the user instructs the printer to perform calibration. It should be noted that the calibration operation is controlled by the control unit 60 of the printer.

First, the printer receives a calibration command (S101). This command is sent to the printer in accordance with a signal from the main computer unit, or as a signal input from the operation section 7. It should be noted that at this time, the carriage 41 is usually in the standby position.

Next, the CR motor is driven to move the carriage in the scanning direction (S102). Then, the carriage 41 moves from the standby position to the printable position.

When the carriage 41 arrives at the printable position, the linear encoder 51 starts to output pulse signals in accordance with the movement of the carriage, and thus the number of pulses is counted (S103). It should be noted that the number of pulses that are counted is information about the movement amount by which the carriage has moved from the printable position. After the carriage 41 passes the printable position, it continues to move toward the printing region.

When the carriage moves further from the printable position, the paper width sensor 54 detects the edge of the paper (S104). That is to say, at first, the paper width sensor 54 outputs a signal indicating the presence of the platen 14, but after this it outputs a signal indicating the presence of paper, and thus when the output signal changes, that position is detected as the position of the edge of the paper.

Lastly, the printer stores the value of the count for when the edge of the paper was detected in the EEPROM of the memory 65 as a correction value (S105).

The correction value stored in the memory 65 is the number of pulses corresponding to the distance from the printable position to the edge of the paper. This correction value is a value that differs for each printer depending on manufacturing errors of the printer.

For example, when the fixed guide 81 is mounted to the left side of an ideal mounting position, the correction value becomes large. Furthermore, when the printable position is positioned to the right side because of a mounting error of the linear encoder, the correction value is also large.

Furthermore, for example, when the fixed guide 81 is mounted to the right side of an ideal mounting position, the correction value becomes small. Furthermore, when the printable position is positioned to the left side because of a mounting error of the linear encoder, the correction value is also small.

Thus, with the present embodiment, even if manufacturing errors are present in each printer, it is possible to set the print start position in accordance with individual printer differences and to calibrate manufacturing errors.

Thus, as shown below, the printer of the present embodiment uses this correction value to calculate the distance X from the printable position to the print start position, and then prints on the paper.

<Printing Operation>

Figure 14:
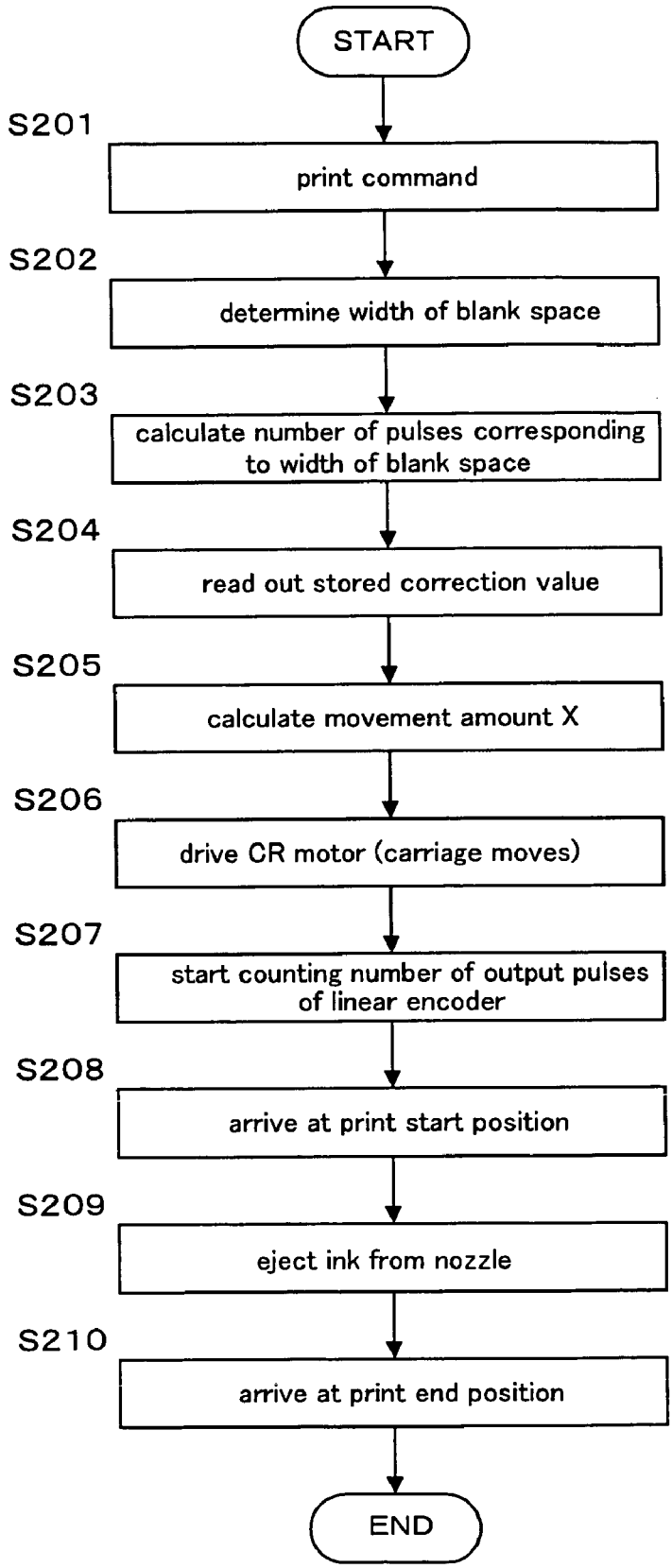
FIG. 14 is a flowchart of a printing operation.

FIG. 14 is a flowchart of the printing operation. The printing operation described here is the printing operation of the first pass. Here, "pass" refers to one scanning movement of the nozzles (or the carriage, or the head) in the scanning direction. It should be noted that this printing operation is controlled by the control unit 60 of the printer.

First, the printer receives a print command (S101). This print command is triggered by a print signal that is transmitted from the main computer unit.

Next, the printer determines the width of the blank space formed on the left and right of the paper (S102). The width of the blank space is usually half the value obtained by subtracting the width of the printing region from the paper width. Here, the paper width can be determined by obtaining information about the printing paper. Furthermore, as regards the width of the printing region, information about the width of the printing region is contained in the print signal transmitted from the main computer unit. It should be noted that when information about the width of the blank space is included in the print signal transmitted from the main computer unit, it is not necessary for the printer to determine the width of the blank space.

Next, the printer calculates the number of pulses of the linear encoder 51, which corresponds to the width of the blank space (S103). For example, if the width of the blank space is 3 mm and the linear encoder 51 outputs one pulse signal every 0.141 mm, the number of pulses that corresponds to a blank-space width of 3 mm is approximately 21.

Next, the printer reads out the stored correction value (S204). Here, the "stored correction value" is the correction value that was determined in the above-noted calibration operation. Thus, this correction value, as noted above, is the number of pulses that corresponds to the distance from the printable position to the edge of the paper.

Next, the printer calculates the distance X from the printable position to the print start position (S205). The distance X from the printable position to the print start position may be the sum of adding the correction value and the number of pulses corresponding to the width of the blank space. That is to say, by calculating the distance X, the print start position is determined.

Next, the printer drives the CR motor to move the carriage in the scanning direction (S206). Thus the carriage 41 moves from the standby position toward the print start position.

As the carriage 41 moves from the standby position toward the print start position, the carriage 41 passes the printable position. Then, when the carriage 41 arrives at the printable position, the linear encoder 51 starts to output pulse signals in accordance with the movement of the carriage, and thus the number of pulses are counted (S207). It should be noted that the number of pulses corresponding to the distance X (i.e., the number of pulses which is the sum of the correction value and the number of pulses corresponding to the width of the blank space) can be decremented every time a pulse signal is output from the linear encoder 51.

When the number of counted pulses becomes the number of pulses corresponding to the distance X, the carriage has reached the print start position (S208). On this timing, the nozzles start to eject ink (S209). Thus, the print start position is set to a position that is located away from the edge of the paper by the width of the blank space that has been set. Further, when the carriage arrives at the print end position (S210), ejection of ink from the nozzles is ended. Thus, the print end position is set to a position that is located away from the edge of the paper by the width of the blank space that has been set. That is to say, the width of the blank space on the left and right is arranged equally.

It should be noted that when printing the next pass, the sequence of the printing operation is repeated in a similar manner. However, since the paper width sensor 54 is capable of detecting the position of both edges of the paper in the first pass, the print start position and the print end position in the second and subsequent passes may be determined based on the positions of the edges that have been detected.

As described above, with the present embodiment, since it is not necessary to detect both edges of the paper with the paper width sensor 54 every time printing is performed, it is possible to shorten the time required for printing.

===Configuration of Computer System Etc.===

Next, an embodiment of a computer system, a computer program, and a storage medium storing the computer program are described with reference to the drawings.

Figure 15:
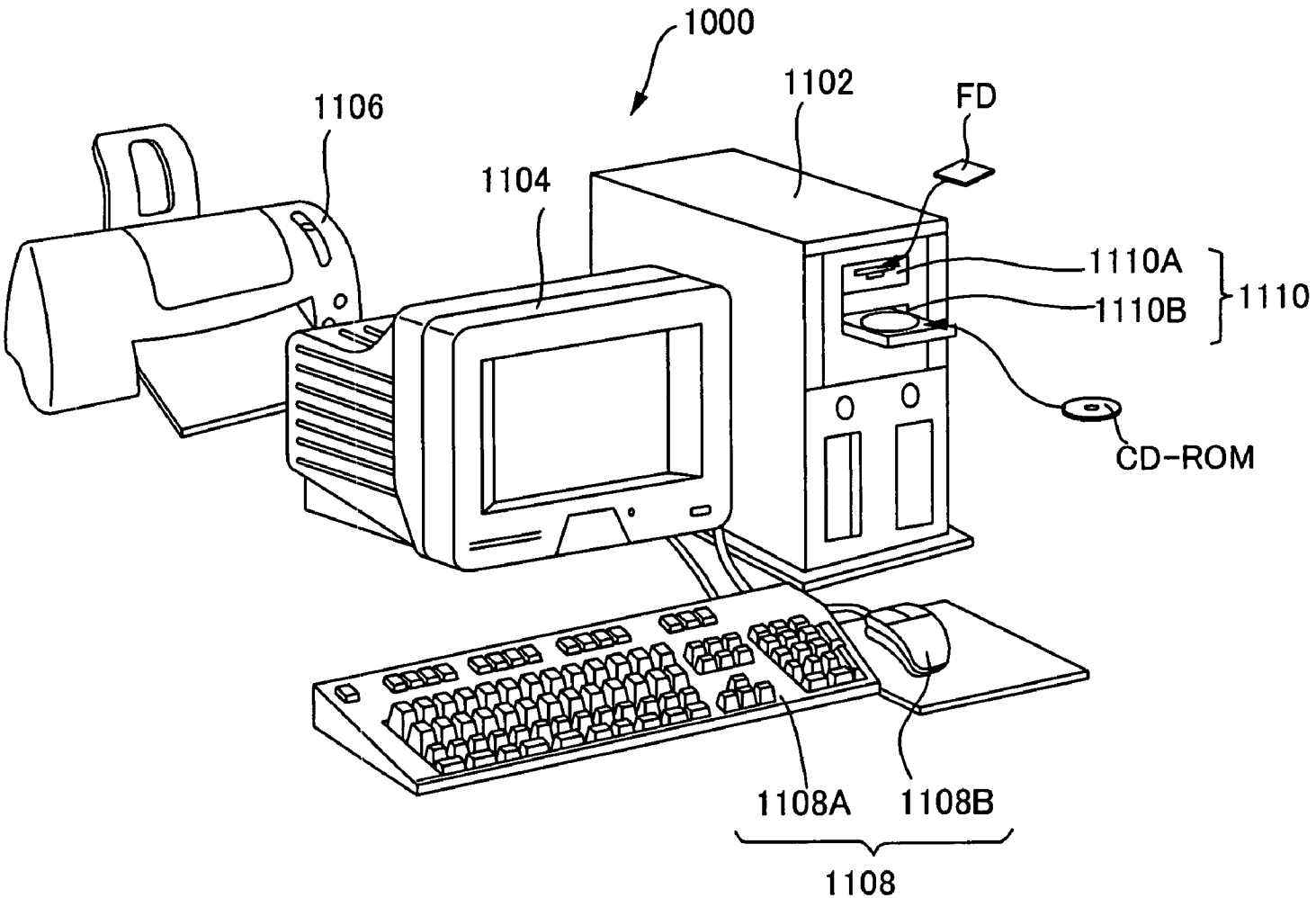
FIG. 15 is an explanatory drawing showing the external structure of a computer system.

FIG. 15 is an explanatory drawing showing the external structure of the computer system. A computer system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), a plasma display, or a liquid crystal display device, for example, is generally used as the display device 1104, but there is no limitation to this. The printer 1106 is the printer described above. In this embodiment, the input device 1108 is a keyboard 1108A and a mouse 1108B, but there is no limitation to these. In this embodiment, a flexible disk drive device 1110A and a CD-ROM drive device 1110B are used as the reading device 1110, but it is not limited to these, and it may also be other types of devices such as a MO (magnet optical) disk drive device or a DVD (digital versatile disk), for example.

Figure 16:
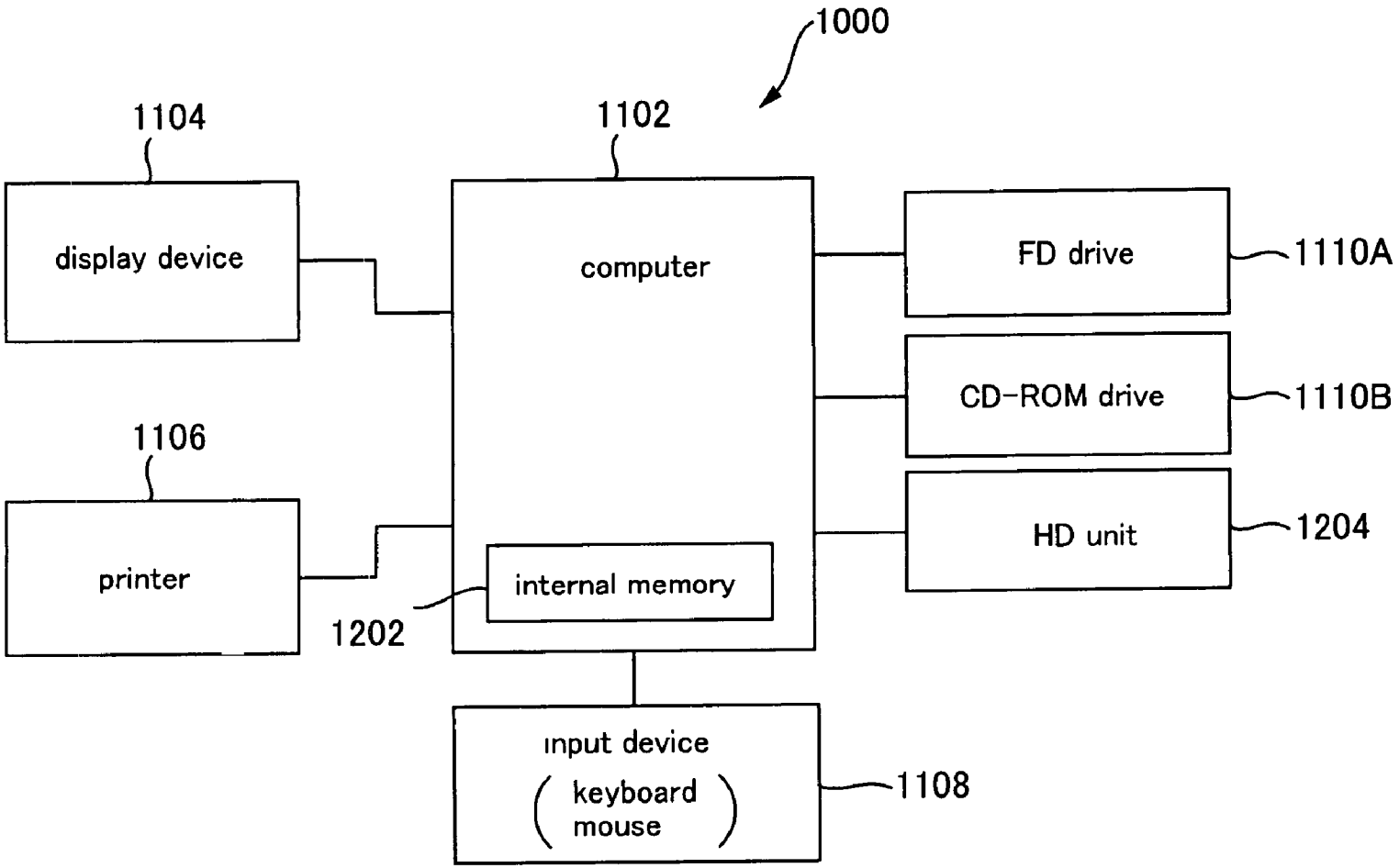
FIG. 16 is a block diagram showing the configuration of the computer system shown in FIG. 15.

FIG. 16 is a block diagram showing the configuration of the computer system shown in FIG. 15. An internal memory 1202 such as a RAM is provided inside the housing accommodating the main computer unit 1102, and also an external memory such as a hard disk drive unit 1204 is provided.

A computer program for controlling the operation of the above printer can be downloaded onto the computer 1000, for example, connected to the printer 1106 via a communications line such as the Internet, and it can also be stored on a computer-readable storage medium and distributed, for example. Various types of storage media can be used as this storage medium, including flexible disks FDs, CD-ROMs, DVD-ROMs, magneto optical disks MOs, hard disks, and memories. It should be noted that information stored on such storage media can be read by various types of reading devices 1110.

Figure 17:
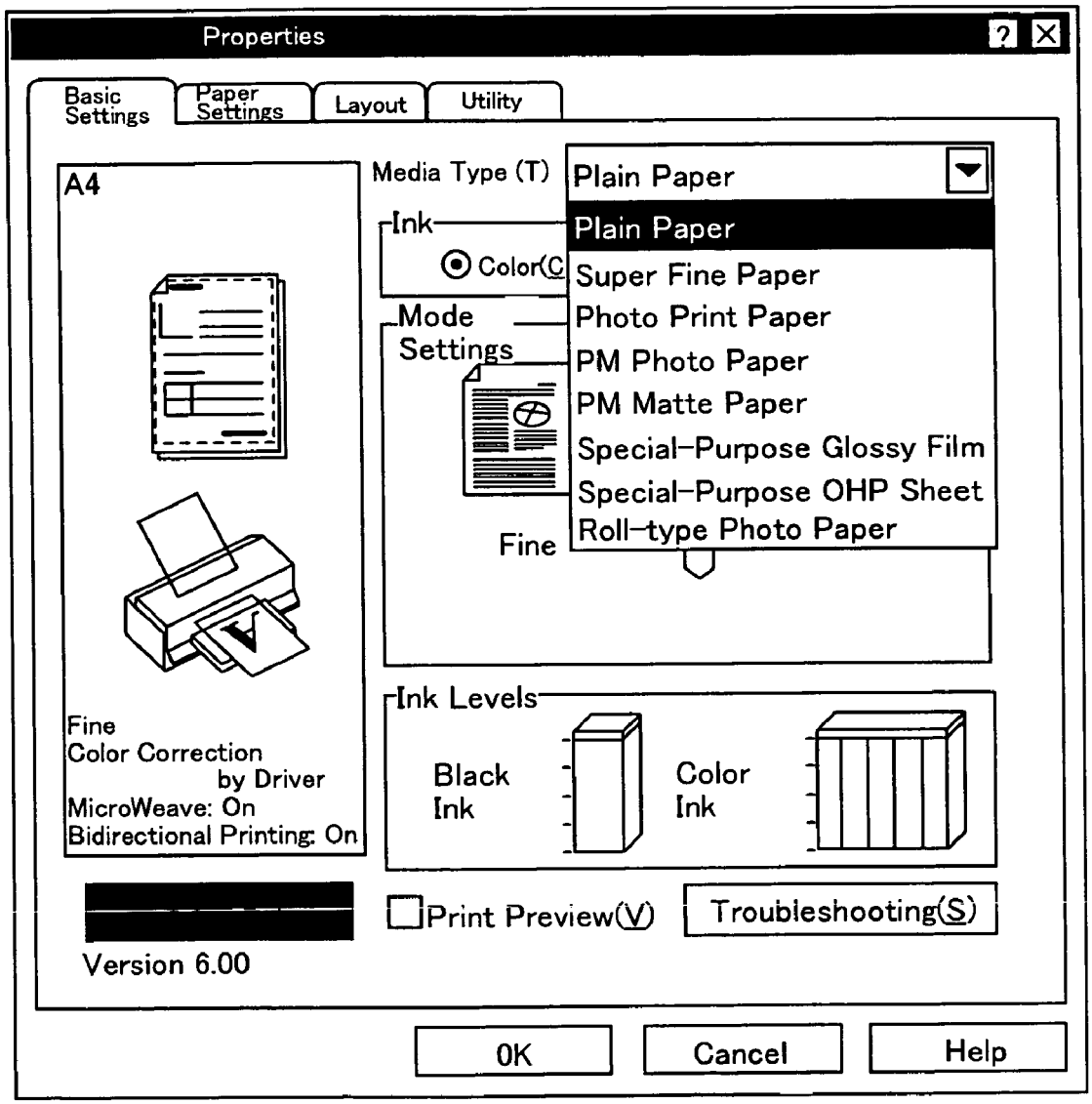
FIG. 17 is an explanatory diagram showing a user interface.

FIG. 17 is an explanatory diagram showing a user interface of a printer driver displayed on the screen of the display device 1104 connected to the computer system. The user can use the input device 1108 to change the various settings of the printer driver.

The user can select the print mode from this screen. For example, the user can select as the print mode a quick print mode or a fine print mode. From this screen the user can also select the dot spacing (resolution) for printing. For example, from this screen the user can select 720 dpi or 360 dpi as the print resolution.

Furthermore, the user can select the type of paper to print from this screen via the input device 1108. The main computer unit obtains the information about the type of paper from the input device 1108. The internal memory 1202 stores a table that associates the information about the type of paper and the information about the paper width. Based on this table, the main computer unit can obtain information about the paper width from the information about the type of paper. Thus, when printing, the main computer unit transmits information about the paper width to the printer. It should be noted that the table that associates the information about the type of paper and the information about the paper width may be stored in the memory 65 of the printer. In this case, the main computer unit transmits information about the type of paper to the printer, and the printer obtains, based on the table, the information about the paper width from the information about the type of paper that was received.

Furthermore, the user can instruct the printer to perform the calibration operation from this screen via the input device 1108. When the main computer unit receives an instruction to perform the calibration operation from the input device 1108, it transmits a calibration command to the printer. Then, when the printer receives the calibration command from the main computer unit, the printer performs the calibration operation as described above. It should be noted that although not shown in the diagram, buttons for instructing the printer to perform the calibration operation may be displayed on the screen. Thus, the calibration operation may be performed not only at the time of shipment from a factory, but at any time desired by the user.

Figure 18:
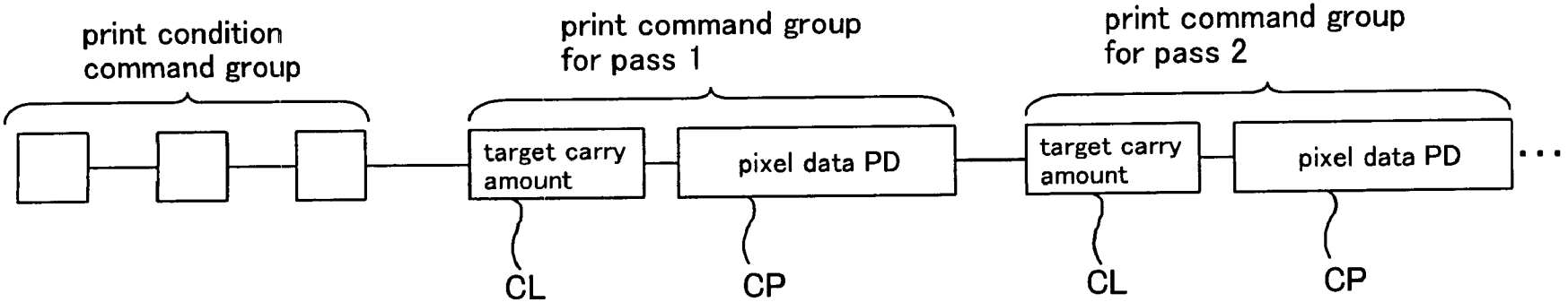
FIG. 18 is an explanatory diagram of a format of print data.

FIG. 18 is an explanatory diagram of a format of print data supplied from the main computer unit 1102 to the printer 1106. The print data are generated from image information based on the settings of the printer driver. The print data have a print condition command group and pass command groups. The print condition command group includes a command for indicating the print resolution and a command for indicating the print direction (single direction/bidirectional), for example. The print command group for each pass includes a target carry amount command CL and a pixel data command CP. The pixel data command CP includes pixel data PD indicating the recording status for each pixel of the dots recorded in that pass. It should be noted that the various commands shown in the diagram each have a header section and a data section; however, here they are shown simplified. Also, these command groups are supplied intermittently command-by-command from the main computer unit side to the printer side. The print data are not limited to this format, however.

In the above description, an example was described in which the computer system is constituted by connecting the printer 1106 to the main computer unit 1102, the display device 1104, the input device 1108, and the reading device 1110; however, this is not a limitation. For example, the computer system can be made of the main computer unit 1102 and the printer 1106, or the computer system does not have to be provided with one of the display device 1104, the input device 1108, and the reading device 1110. It is also possible, for example, for the printer 1106 to have some of the functions or mechanisms of the main computer unit 1102, the display device 1104, the input device 1108, and the reading device 1110. For example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

In the embodiment described above, it is also possible for the computer program for controlling the printer to be taken into the memory 65, which is a storage medium, of the control unit 60. The control unit 60 may execute the computer program stored in the memory 65 so as to achieve the operations of the printer in the embodiment described above.

As an overall system, the computer system that is thus achieved is superior to conventional systems.

===Other Embodiments===

The foregoing embodiment has been described focusing mainly on a printer. However, it goes without saying that the foregoing also includes the disclosure of printing apparatuses, printing methods, programs, storage media, computer systems, display screens, screen display methods, methods of manufacturing printed material, recording apparatuses, and devices for ejecting liquids, for example.

Also, a printer, for example, serving as an embodiment was described above. However, the foregoing embodiment is for the purpose of elucidating the present invention and is not to be interpreted as limiting the present invention. The invention can of course be altered and improved without departing from the gist thereof and includes equivalents. In particular, the embodiments mentioned below are also included in the invention.

<Regarding the Recording Apparatus>

In the embodiment described above, a printer was described as the recording apparatus. This is not a limitation, however. For example, technology like that of the present embodiment can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, methods therefor and manufacturing methods thereof are within the scope of application. Even when the present technology is adopted in these fields, the fact that liquid can be directly ejected (written) to a target object allows a reduction in material, process steps, and costs compared to conventional cases to be achieved.

<Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, machining liquid, and genetic solutions. A reduction in material, process steps, and costs can be achieved if such liquids are directly ejected toward a target object.

<Regarding the Nozzles>

In the foregoing embodiment, ink was ejected using piezoelectric elements. However, the method for ejecting liquid is not limited to this. Other methods, such as a method for generating bubbles in the nozzles through heat, may also be employed.

<(1) Regarding Storing of the Correction Value>

With the embodiment described above, the correction value detected according to the calibration operation is the number of pulses (count value) of the pulse signal output from the encoder. However the correction value is not limited to this.

For example, the correction value may be a signal relating to the position of the carriage for when the paper width sensor detected the edge of the paper. That is to say, provided that the correction value expresses the position of the edge of the paper, it may be in other forms.

<(2) Regarding Storing of the Correction Value>

With the embodiment described above, the correction value detected according to the calibration operation is stored in the memory 65 of the control unit 60 of the printer. However, the location in which the correction value is stored is not limited to this. For example, the correction value detected according to the calibration operation may be stored in the memory of the main computer unit. In this case, the printer first receives the calibration command and performs the calibration operation, and then automatically transmits, to the main computer unit, the correction value that has been detected.

<Regarding the Blank Space>

In the foregoing embodiment, when printing on the paper, a blank space of 3 mm is formed on the left and right. That is to say, in the foregoing embodiment, the edge of the paper and the print start position are separated by 3 mm. However the relative positional relationship between the edge of the paper and the print start position is not limited to this.

For example, it goes without saying that the width of the blank space may differ from 3 mm.

Furthermore, for example, the printing may also be printing performed on the entire surface of the paper, that is, printing in which no blank space is created, such as so-called borderless printing. Furthermore, if borderless printing is performed, then the print start position may be outside of the medium to be printed or on the position of the edge of the paper (the position at which the blank space becomes zero). In this way, when performing so-called borderless printing, the print start position can be provided at an appropriate position and also the time required for printing can be shortened.

INDUSTRIAL APPLICABILITY

With the printing apparatus of the present invention, it is possible to provide the print start position at an appropriate position, as well as shorten the time required for printing.

The invention claimed is:

1. A printing apparatus that forms a row of dots from a print start position in a scanning direction to print on a medium to be printed, said apparatus comprising:

a fixed guide;

a movable guide that is movable in said scanning direction; and a controller that causes a sensor to detect an edge that is guided by said fixed guide, in said scanning direction, of said medium to be printed, and that determines said print start position based on a result of detecting said edge of another medium to be printed without using a result of detecting the other edge that is guided by said movable guide.

2. A printing apparatus according to claim 1, wherein said result of detecting said edge of said other medium to be printed is stored; and wherein when printing on said medium to be printed, the stored detection result is read out, and said print start position is determined based on that detection result.

3. A printing apparatus according to claim 1, wherein said sensor is provided on a carriage that is movable in said scanning direction.

4. A printing apparatus according to claim 3, wherein said print start position is determined based on information about a position of said carriage for when said sensor detected said edge of said other medium to be printed.

5. A printing apparatus according to claim 4, wherein said position of said carriage is detected using an encoder.

6. A printing apparatus according to claim 4, wherein said information about said position of said carriage for when said sensor detected said edge of said other medium to be printed is stored;

wherein when printing on said medium to be printed, said information about said position of said carriage that has been stored is read out; and wherein said print start position is determined based on said information about said position of said carriage that has been read out.

7. A printing apparatus according to claim 1, wherein information about a relative positional relationship between said edge of said medium to be printed and said print start position is obtained; and wherein said print start position is determined based on this information and said result of detecting said edge.

8. A printing apparatus according to claim 7, wherein said information about said relative positional relationship between said edge of said medium to be printed and said print start position includes information about a blank space that is to be formed on said medium to be printed.

9. A printing apparatus according to claim 1, wherein information about said medium to be printed is obtained; and wherein said print start position is determined based on said information about said medium to be printed and said result of detecting said edge.

10. A printing apparatus according to claim 9, wherein said information about said medium to be printed includes information about a width of said medium to be printed.

11. A printing apparatus according to claim 1, wherein printing is carried out on an entire surface of said medium to be printed; and wherein said print start position is a position in said scanning direction that is outside of or on the edge of the medium to be printed.

12. A printing apparatus that forms a row of dots from a print start position in a scanning direction to print on a medium to be printed, said apparatus comprising:

a fixed guide;

a movable guide that is movable in said scanning direction; and a controller that causes a sensor to detect an edge that is guided by said fixed guide, in said scanning direction, of said medium to be printed;

wherein said sensor is provided on a carriage that is movable in said scanning direction;

wherein a position of said carriage is detected using an encoder;

wherein information about said position of said carriage for when said edge of said other medium to be printed was detected is stored;

wherein at least one of information about a width of said medium to be printed and information about a blank space that is to be formed on said medium to be printed is obtained;

wherein when printing on said medium to be printed, said information about said position of said carriage is read out;

wherein said print start position is determined based on said information about said position of said carriage, and at least one of said information about the width of said medium to be printed and said information about the blank space that is to be formed on said medium to be printed; and wherein said print start position is determined without using a result of detecting the other edge that is guided by said movable guide.

13. A computer-readable storage medium comprising instructions for causing a printing apparatus that forms a row of dots from a print start position in a scanning direction to print on a medium to be printed, to perform a method comprising:

moving a movable guide in said scanning direction;

detecting an edge that is guidable by a fixed guide, in said scanning direction, of said medium to be printed; and determining said print start position based on a result of detecting said edge of another medium to be printed without using a result of detecting the other edge that is guided by said movable guide.

14. A printing method for printing on a medium to be printed, said method comprising:

a step of preparing a printing apparatus having a fixed guide, and a movable guide that is movable in a scanning direction;

a step of detecting an edge, in said scanning direction, of another medium to be printed, the edge being guided by said fixed guide;

a step of determining a print start position based on a result of detecting said edge of said other medium to be printed;

a step of ejecting ink droplets, in said scanning direction, from the determined print start position to print on a medium to be printed that is different from said other medium to be printed;

wherein said print start position is determined without using a result of detecting the other edge that is guided by said movable guide.

* * * * *